US009171416B2

(12) United States Patent
Iwamura et al.

(10) Patent No.: US 9,171,416 B2
(45) Date of Patent: Oct. 27, 2015

(54) BANKNOTE HANDLING APPARATUS AND BANKNOTE HANDLING METHOD

(71) Applicant: GLORY LTD., Himeji-shi, Hyogo (JP)

(72) Inventors: Michiharu Iwamura, Hyogo (JP); Toshiki Tanaka, Hyogo (JP); Tsuguo Mizoro, Hyogo (JP)

(73) Assignee: GLORY LTD., Himeji-Shi, Hyogo (JP)

( * ) Notice: Subject to any disclaimer, the term of this patent is extended or adjusted under 35 U.S.C. 154(b) by 0 days.

(21) Appl. No.: 14/270,513

(22) Filed: May 6, 2014

(65) Prior Publication Data

US 2014/0238815 A1 Aug. 28, 2014

Related U.S. Application Data

(63) Continuation of application No. 13/575,681, filed as application No. PCT/JP2011/051934 on Jan. 31, 2011, now Pat. No. 8,733,531.

(30) Foreign Application Priority Data

Jan. 29, 2010 (JP) ..... 2010-019613
Jan. 29, 2010 (JP) ..... 2010-019614
Mar. 19, 2010 (JP) ..... 2010-065189

(51) Int. Cl.

| | |
|---|---|
| ***G07F 7/04*** | (2006.01) |
| ***G07F 19/00*** | (2006.01) |
| ***G07D 11/00*** | (2006.01) |

(52) U.S. Cl.

CPC ..... *G07F 7/04* (2013.01); *G07D 11/0051* (2013.01); *G07D 11/0075* (2013.01); *G07D 11/0084* (2013.01); *G07F 19/202* (2013.01)

(58) Field of Classification Search

CPC ..... G07D 11/00; G07D 11/0018; G07D 11/0084; G07F 7/04
USPC ..... 194/200, 206, 217; 235/379; 209/534
See application file for complete search history.

(56) References Cited

U.S. PATENT DOCUMENTS

| | | | | |
|---|---|---|---|---|
| 4,883,183 | A * | 11/1989 | Kimura et al. | 209/534 |
| 4,889,240 | A * | 12/1989 | Sato et al. | 209/534 |
| 6,659,260 | B2 * | 12/2003 | Otsuka et al. | 194/302 |
| 2008/0047801 | A1 * | 2/2008 | Nakatsuka et al. | 194/206 |

* cited by examiner

*Primary Examiner* — Mark Beauchaine
(74) *Attorney, Agent, or Firm* — Renner, Kenner, Greive, Bobak, Taylor & Weber

(57) ABSTRACT

A banknote handling apparatus that performs a depositing handling or a depositing/dispensing handling by transporting banknotes along a transport path includes a recognizing unit that recognizes an inserted banknotes; a deposit acceptability judging unit that determines, based on a recognition result obtained by the recognizing unit, whether the banknotes is acceptable for deposit; a reject reason identifying unit that identifies a reject reason of rejected banknotes that is determined to be unacceptable for deposit by the deposit acceptability judging unit; and a dispensing handling unit that sorts and dispenses the rejected banknotes based on the reject cause identified by the reject cause identifying unit.

16 Claims, 24 Drawing Sheets

FIG.1A
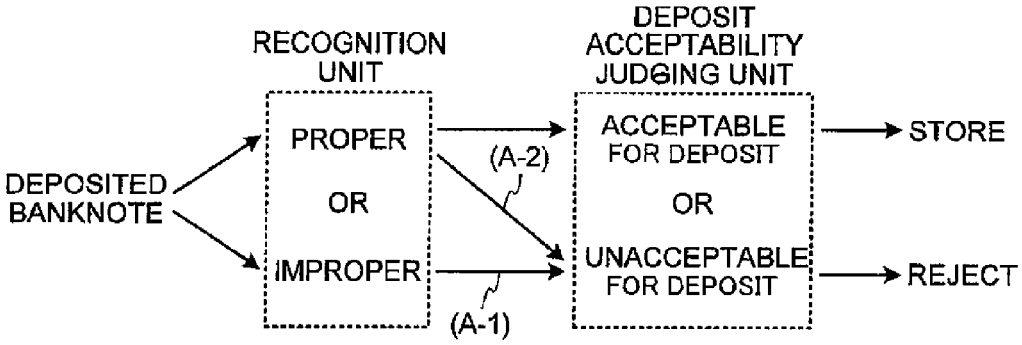
FIG.1B
| | | REJECT REASON | |
|---|---|---|---|
| REJECTED BANKNOTE | (A-1) | COUNTERFEIT BANKNOTE, UNFIT BANKNOTE etc. | (B-1) REJECTED IMPROPER BANKNOTE |
| | | TRANSPORT ERROR | (B-2) REJECTED PROPER BANKNOTE |
| | (A-2) | STORAGE ERROR | |
| | | NOT HANDLING TARGET | (B-1) REJECTED IMPROPER BANKNOTE |
FIG.1C
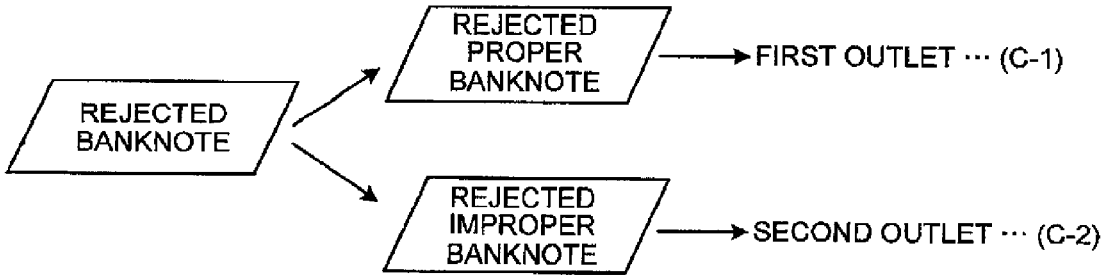

FIG.10A
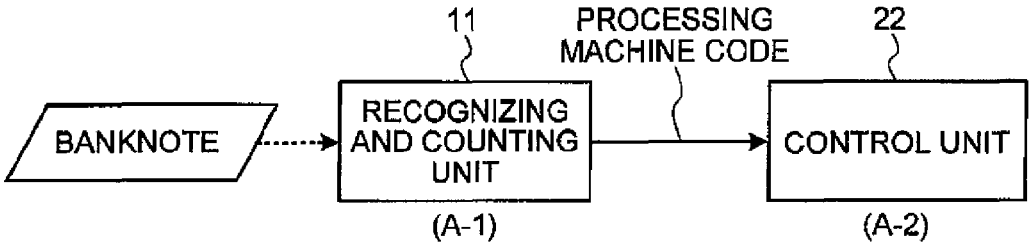
FIG.10B
| RECOGNITION MACHINE CODE (RECOGNITION RESULT) | | | PROCESSING MACHINE CODE |
|---|---|---|---|
| COUNTRY | VERSION | DENOMI-NATION | |
| US | 0 | 1 | 1 |
| US | 0 | 5 | 2 |
| US | 0 | 10 | 3 |
| US | 0 | 20 | 4 |
| US | 0 | 50 | 5 |
| US | 0 | 100 | 6 |
| US | 1 | 1 | 7 |
| US | 1 | 5 | 8 |
FIG.10C
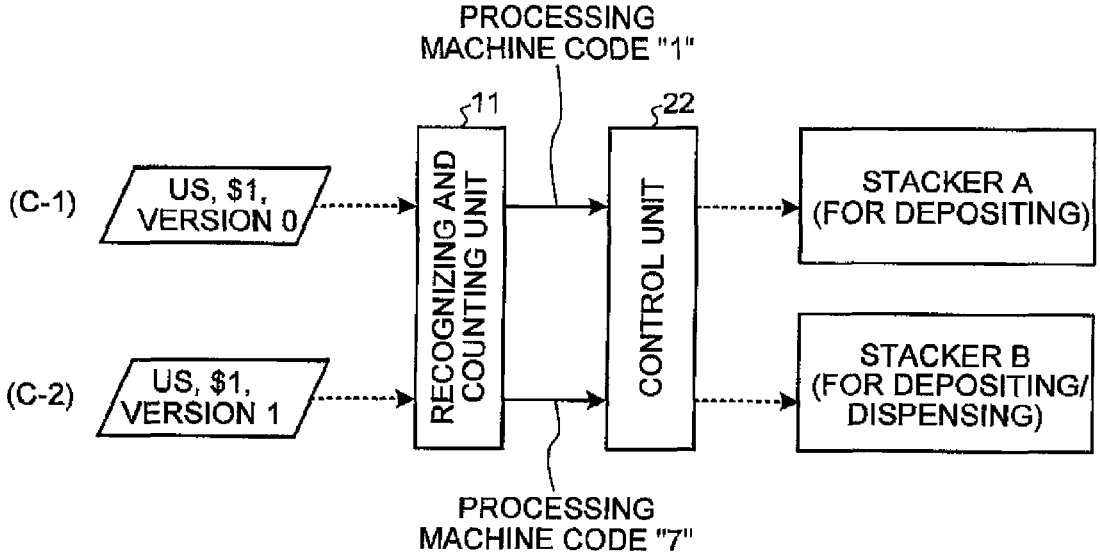

REPLACEMENT TABLE

| PRE-REPLACEMENT PROCESSING MACHINE CODE | POST-REPLACEMENT PROCESSING MACHINE CODE |
|---|---|
| 1 | 7 |
| 2 | 8 |

FIG.15A

| | STEP 1 | STEP 2 | STEP 3 |
|---|---|---|---|
| INLET | 10,000-YEN BANKNOTES<br>5,000-YEN BANKNOTES<br>1,000-YEN BANKNOTES<br>REJECTED BANKNOTES | | |
| OUTLET | | 10,000-YEN BANKNOTES | 1,000-YEN BANKNOTES |
| REJECT UNIT | | 5,000-YEN BANKNOTES<br>REJECTED BANKNOTES | 5,000-YEN BANKNOTES<br>REJECTED BANKNOTES |
| ESCROW UNIT | | 1,000-YEN BANKNOTES | |

FIG.15B

| | STEP 1 | STEP 2 |
|---|---|---|
| INLET | 10,000-YEN BANKNOTES<br>1,000-YEN BANKNOTES | |
| OUTLET | | 10,000-YEN BANKNOTES |
| REJECT UNIT | | 1,000-YEN BANKNOTES |
| ESCROW UNIT | | |

FIG.15C

| | STEP 1 | STEP 2 | STEP 3 |
|---|---|---|---|
| INLET | 10,000-YEN BANKNOTES<br>1,000-YEN BANKNOTES | | |
| OUTLET | | 10,000-YEN BANKNOTES (FACE UP) | 10,000-YEN BANKNOTES (FACE UP) |
| REJECT UNIT | | 1,000-YEN BANKNOTES (FACE UP) | 1,000-YEN BANKNOTES (FACE UP) |
| ESCROW UNIT | | 10,000-YEN BANKNOTES (FACE DOWN)<br>1,000-YEN BANKNOTES (FACE DOWN) | |

FIG.15D

| | STEP 1 | STEP 2 | STEP 3 |
|---|---|---|---|
| INLET | 10,000-YEN BANKNOTES | | |
| OUTLET | | 10,000-YEN BANKNOTES (FACE UP, PORTRAIT UPRIGHT) | 10,000-YEN BANKNOTES (FACE UP, PORTRAIT UPRIGHT) |
| REJECT UNIT | | 10,000-YEN BANKNOTES (FACE UP, PORTRAIT INVERTED) | 10,000-YEN BANKNOTES (FACE UP, PORTRAIT INVERTED) |
| ESCROW UNIT | | 10,000-YEN BANKNOTES (FACE DOWN, PORTRAIT UPRIGHT)<br>10,000-YEN BANKNOTES (FACE DOWN, PORTRAIT INVERTED) | |

FIG.19

| | MODE SWITCHING CONDITIONS |
|---|---|
| (T1) | MODE SWITCHING OPERATION |
| (T2) | TIME OF DAY AND DAY OF WEEK |
| (T3) | AMOUNT OF BANKNOTES INSERTED |
| (T4) | AMOUNT OF BANKNOTES FED OUT |
| (T5) | ENVIRONMENTAL NOISE LEVEL |

FIG.20

| OPERATION MODE | TRANSPORT SPEED | FEEDING SPEED | LIGHTING LEVEL | LIGHTING DURATION | FLAG SETTING |
|---|---|---|---|---|---|
| NORMAL MODE | 1600 mm/SEC | 10 BANK-NOTES/SEC | BRIGHT | 10 SECONDS | YES |
| ECO-FRIENDLY MODE | 1200 mm/SEC | 7 BANK-NOTES/SEC | DARK | 5 SECONDS | NO |

| TRANSPORT SPEED | POWER CONSUMPTION | POWER CONSUMPTION REDUCTION RATE | NOISE LEVEL | NOISE REDUCTION RATE |
|---|---|---|---|---|
| 1600 mm/SEC | 100W | 0% | 50dB | 0% |
| ⋮ | ⋮ | ⋮ | ⋮ | ⋮ |
| 1200 mm/SEC | 95W | 5% | 45dB | 10% |
| ⋮ | ⋮ | ⋮ | ⋮ | ⋮ |
| 800 mm/SEC | 85W | 15% | 35dB | 30% |

BANKNOTE HANDLING APPARATUS AND BANKNOTE HANDLING METHOD

CROSS-REFERENCE TO RELATED APPLICATION

This application is a continuation of U.S. patent application Ser. No. 13/575,681 filed on Jul. 27, 2012, which claims priority from PCT Application No. PCT/JP2011/051934 filed on Jan. 31, 2011 and prior Japanese Patent Application Nos. JP2010-019613 and 2010-019614 both filed on Jan. 29, 2010 and JP2010-065189 filed on Mar. 19, 2010, the entire contents of which are incorporated by reference.

TECHNICAL FIELD

The present invention relates to a banknote handling apparatus and a banknote handling method that performs a banknote depositing transaction or depositing/dispensing transaction. The present invention especially relates to a banknote handling apparatus and a banknote handling method that have a plurality of modes of transactions and operations and facilitate a rejected banknote re-depositing task to efficiently perform banknote handling processes.

BACKGROUND ART

A banknote handling apparatus that is installed in a financial institution such as a bank and that performs banknote depositing/dispensing transactions is known in the art. Such a banknote handling apparatus uses a recognizing unit to recognize denominations and authenticity of banknotes that are deposited into an inlet, and stores the banknotes that have been recognized as proper banknotes into storing units that correspond to respective denominations. Meanwhile, the banknote handling apparatus disclosed in Patent Document 1 dispenses banknotes that are stored in the storing units to an outlet in response to the operator's operation (see Patent Documents 1 and 2, for example).

The banknote handling apparatus has also been known (see Patent Document 3, for example). That is, when dispensing banknotes that are stored in the storing units, the banknote handling apparatus recognizes the face/back orientation of the banknotes and reverses banknotes that are recognized as being face-down (or face-up) so that all the banknotes can be dispensed with a uniform face/back orientation.

If any improper banknotes such as counterfeit banknotes and unfit banknotes are included in the deposited banknotes, the banknote handling apparatus disclosed in Patent Document 1 dispenses these improper banknotes as rejected banknotes to a reject unit.

The rejected banknotes can include not only improper banknotes as described above, but also proper banknotes that fail to be stored because the storing unit is already full, for example. Similarly, the rejected banknotes can also include proper banknotes that are judged as unidentifiable because they are transported in a skewed manner or with other banknotes attached thereto. In other words, the rejected banknotes can include banknotes that could be properly handled if they are subjected to the recognition process again.

The operator therefore performs a re-depositing task of, for example, collecting banknotes from the filled storing unit and then reinserting the rejected banknotes discharged to the reject unit into the inlet so that the proper banknotes included in the rejected banknotes can be stored in the storing unit.

PRIOR ART DOCUMENTS

Patent Documents

Patent Document 1: Japanese Patent Application Laid-open No. 2004-145600

Patent Document 2: Japanese Patent Application Laid-open No. 2008-310552

Patent Document 3: Japanese Patent Application Laid-open No. H9-52648

DISCLOSURE OF INVENTION

Problem to be Solved by the Invention

However, there is a problem in the conventional banknote handling apparatus that the operator cannot efficiently perform a rejected banknote re-depositing task. This is because the conventional banknote handling apparatus discharges to the reject unit the rejected banknotes in which both the proper banknotes and the improper banknotes are mixed.

Thus, the conventional technology requires that unacceptable rejected banknotes such as counterfeit banknotes and unfit banknotes be subjected to the re-depositing task, which requires extra time and trouble.

The rejected banknotes can include no proper banknote at all. It is difficult, however, for the operator to determine that no proper banknote is included in the rejected banknotes by simply looking at the rejected banknotes stacked in the reject unit. The operator therefore needs to perform the re-depositing task even when no proper banknote is included in the rejected banknotes.

Thus, a major challenge is how to realize a banknote handling apparatus or a banknote handling method where the rejected banknote re-depositing task can be efficiently performed.

Meanwhile, in the conventional banknote handling apparatus having a plurality of storing units, the deposited banknotes that are recognized and counted are stored in the storing units provided corresponding to the recognition results such as the denominations and authenticity. Therefore, when only counting and recognition of banknotes are to be performed, a separate apparatus is required. This poses problems regarding the installation space and equipment costs.

Similarly, in the conventional handling apparatus, a banknote face/back reversing process needs to be performed before the deposited banknotes are stored in the storing unit at the time of depositing, or before the banknotes are discharged to the outlet at the time of dispensing. If the banknote reversing process is to be performed without performing depositing or dispensing transactions, a separately installed dedicated apparatus is required even when the banknote handling apparatus for the depositing/dispensing process includes a face/back reversing function.

It has been desired to realize, without separately installing a dedicated apparatus, recognition and counting of banknotes that are not to be deposited or dispensed on a banknote handling apparatus that has a plurality of storing units.

Moreover, recently with a growing interest in environment, there has been a demand for an apparatus that realizes reduction in environmental load, in addition to the demand for the functions and performance of the apparatus as described above. The reduction in environmental load here means, for example, reduction in the load on the global environment and living environment such as electric power saving and noise reduction.

For example, when high-speed processing is to be realized, a driving unit of the banknote handling apparatus, such as a motor and an actuator, needs to be operated at high speed. If the driving unit is operated at high speed, the frictional force and the like acting on the components of the driving unit increases, and the energy loss increases, which makes it difficult to achieve power conservation.

Moreover, when the driving unit is operated at high speed, noise that is generated, for example, by the stacking wheel (elastic fin wheel) and other rotating members to stack the transported banknotes in an aligned manner, increases. This makes it difficult to reduce noise.

Hence, there is a need for a banknote handling apparatus that can realize both high-speed processing and environmental load reduction.

The present invention has been conceived to solve the above problems residing in the conventional technology. It is an object of the present invention to offer a banknote handling apparatus and a banknote handling method that perform various banknote transactions with various modes so that both high-speed processing and environmental load reduction can be achieved, and also that efficiently perform banknote-related transactions by making the rejected banknote re-depositing task easy.

Means for Solving Problem

To solve the above problems and to achieve the above objects, according to an aspect of the present invention, a banknote handling apparatus that performs a depositing process or a depositing/dispensing process by transporting banknotes along a transport path includes a recognition unit that recognizes an inserted banknote; a deposit acceptability judging unit that determines, based on a recognition result obtained by the recognition unit, whether the banknote is acceptable for deposit; a reject reason identifying unit that identifies a reject reason of a rejected banknote which is determined to be unacceptable for deposit by the deposit acceptability judging unit; and a dispensing processing unit that sorts and dispenses the rejected banknotes based on the reject reason identified by the reject reason identifying unit. In this manner, the rejected banknote re-depositing task can be efficiently performed.

Furthermore, according to another aspect of the present invention, the banknote handling apparatus, which recognizes banknotes deposited to the inlet using the recognizing unit and stores them in a storing unit and also discharges the banknotes stored in the storing unit to the outlet, includes a mode switching unit that switches an operation mode between a first mode in which the banknotes recognized by the recognizing unit are stored in the storing units and a second mode in which the banknotes recognized by the recognizing unit are discharged without being stored in the storing units; an escrow unit that feeds in and escrows the banknotes recognized by the recognizing unit, and feeds out the escrowed banknotes; a sorting unit that, when the operation mode is the second mode, sends the banknotes to one of an outlet and the escrow unit, in accordance with the recognition result obtained by the recognizing unit; and a feeding unit that feeds the banknotes that were sent to the escrow unit by the sorting unit out to one of the outlet and the inlet. Thus, the deposited banknotes can be recognized without being stored.

Furthermore, according to still another aspect of the present invention, the banknote handling apparatus that has a transport path for transporting the banknotes includes a mode switching unit that switches an operation mode between a third mode in which the transport path is driven at a first transport speed and a fourth mode in which the transport path is driven at a second transport speed that is lower than the first transport speed; and a drive control unit that drives the transport path at a transport speed corresponding to the operation mode switched by the mode switching unit. Thus, the high-speed processing and the environmental load reduction can be achieved at the same time.

Advantages of the Invention

By using the banknote handling apparatus and the banknote handling method according to the present invention, banknote-related transactions can be efficiently performed.

BRIEF DESCRIPTION OF DRAWINGS

FIGS. 1A to 1C are diagrams showing an outline of a banknote handling technique according to the present invention.

FIGS. 10A to 10C are diagrams for explaining a depositing/dispensing transaction performed based on a machine code.

FIGS. 15A to 15D are diagrams showing another operation example of the banknote sorting unit and the escrowed banknote feeding unit.

FIG. 19 is a diagram showing an example of conditions for switching to an eco-friendly mode.

FIG. 20 is a diagram showing an example of mode setting information.

BEST MODE(S) FOR CARRYING OUT THE INVENTION

Figure 2:
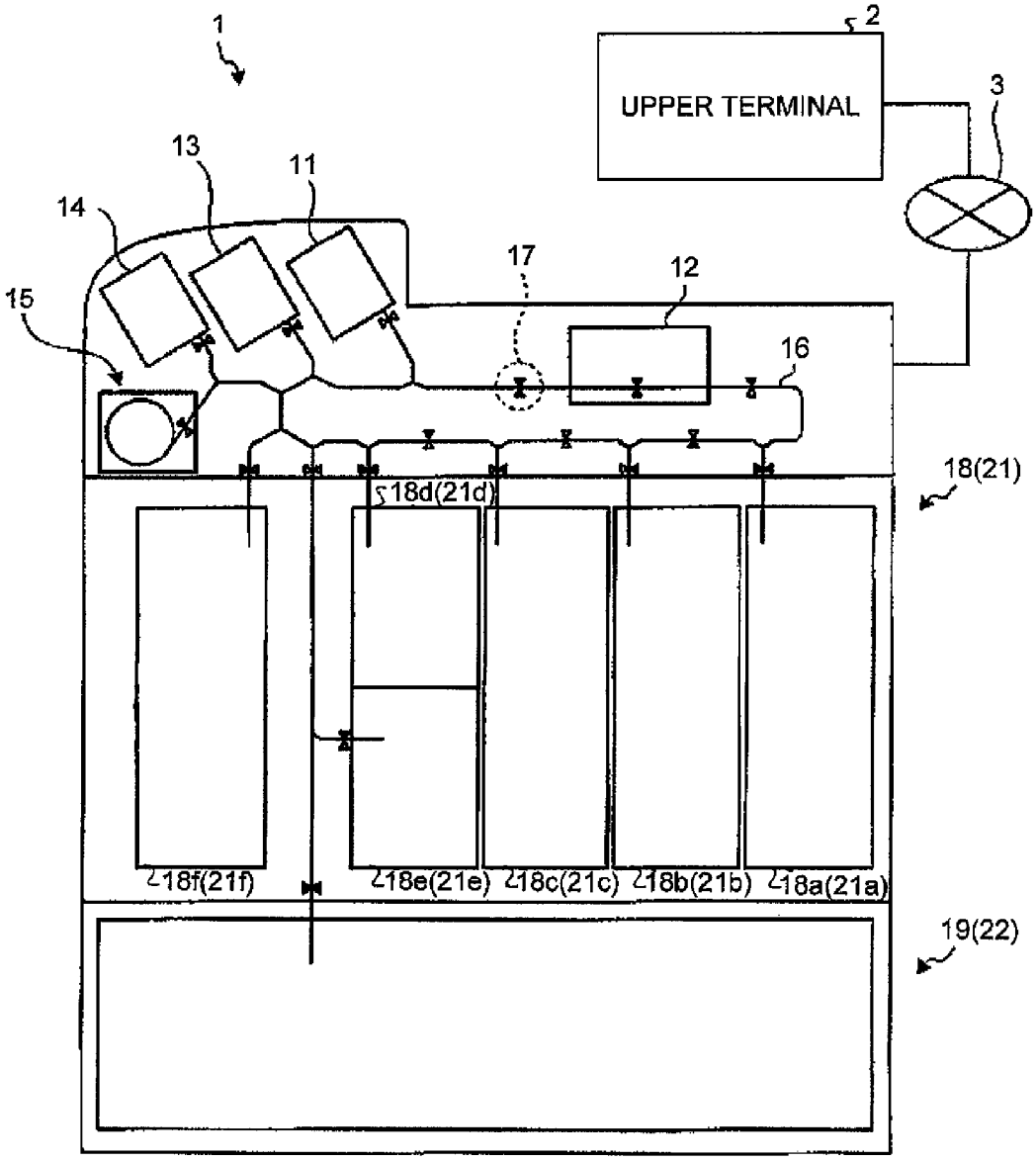
FIG. 2 is a diagram showing an internal structure of a banknote handling apparatus according to a first embodiment.

Exemplary embodiments of a banknote handling apparatus according to the present invention are explained in detail below with reference to the accompanying drawings.

First, an outline of a banknote handling technique according to the present invention is explained with reference to FIG. 1, before detailed explanation of the embodiments is presented. FIGS. 1A to 1C are diagrams showing the outline of the banknote handling technique according to the present invention. FIG. 1A is a drawing showing the outline of the processing of the banknote handling apparatus, FIG. 1B is a drawing showing specific examples of reject reasons, and FIG. 1C is a drawing showing operation examples of the dispensing process related to rejected banknotes.

With the banknote handling technique according to the present invention, rejected banknotes which are judged as being unacceptable in a deposit process can be sorted and dispensed separately based on the reject reason.

More specifically, as shown in FIG. 1A, with the banknote handling technique according to the present invention, first, banknotes that are inserted into the banknote handling apparatus are recognized by a recognizing unit. The recognizing unit recognizes denominations, authenticity, fitness, face/back, and the like of the banknotes.

Thereafter, with the banknote handling technique according to the present invention, a deposit acceptability judging unit determines whether the deposit of the banknotes is acceptable based on the recognition result obtained by the recognizing unit, and stores the banknotes that are judged as being acceptable in storing units corresponding to the denomination. Furthermore, with the banknote handling technique according to the present invention, the banknotes that are judged as being unacceptable by the deposit acceptability judging unit are dispensed as rejected banknotes to an outlet. In other words, the banknote handling apparatus discharges the rejected banknotes, while storing other normal banknotes therein in accordance with their denominations, based on the recognition result obtained by the recognizing unit.

The rejected banknotes, however, can include banknotes the deposit of which is judged as being unacceptable by the deposit acceptability judging unit based on a result that the banknotes are recognized as being improper by the recognizing unit even though they are proper banknotes (see (A-1) of FIG. 1A). Moreover, the rejected banknotes can include banknotes the deposit of which is judged as being unacceptable by the deposit acceptability judging unit even though they are judged as being proper banknotes by the recognizing unit (see (A-2) of FIG. 1A).

More specifically, as shown in FIG. 1B, in addition to a case where a banknote is rejected because it is recognized by the recognizing unit as a counterfeit banknote or an unfit banknote, there is a case where the banknote is rejected because it cannot be recognized due to a transport error such as skewed transport or chained transport.

Even if the recognizing unit recognizes a banknote as a proper one, there is a case where the banknote is rejected because the storing unit is full or malfunctioning and therefore cannot store the banknote therein. Also there is a case where the banknote is rejected because the banknote is not included in the handling targets of the banknote handling apparatus.

Among these reject reasons, when a reject reason is that the banknote is recognized as a counterfeit banknote or an unfit banknote, or a reject reason is that the banknote is not the handling target, the rejected banknote would not be properly processed even when it is reinserted into the banknote handling apparatus. However, when a reject reason is a transport error such as skewed transport and chained transport, or a reject reason is a storage error such as the storing unit being full or malfunctioning, the rejected banknote should originally be a proper banknote. Therefore, if the rejected banknote is reinserted into the banknote handling apparatus, it will be properly handled (in other words, it will be stored inside the banknote handling apparatus).

In view of the above discussion, with the banknote handling technique according to the present invention, the reject reason is identified before discharging the rejected banknotes, and the rejected banknotes are sorted and dispensed in accordance with the identified reject reason. More specifically, with the banknote handling technique according to the present invention, the rejected banknotes are sorted and dispensed as rejected improper banknotes (see (B-1) of FIG. 1B) that would not be properly handled even if they are reinserted, and rejected proper banknotes (see (B-2) of FIG. 1B) that can be properly handled after being reinserted.

For example, as shown in FIG. 10, with the banknote handling technique according to the present invention, the rejected proper banknotes can be dispensed to a first outlet (see (C-1) of FIG. 10), while the rejected improper banknotes can be dispensed to a second outlet (see (C-2) of FIG. 10). In this manner, different dispensing destinations are selected for the rejected proper banknotes and the rejected improper banknotes so that the operator can readily pick up the rejected proper banknotes only, and therefore the re-depositing task can be efficiently performed.

Instead, the rejected proper banknotes and the rejected improper banknotes can be sorted by using a single outlet. For example, the banknote handling apparatus can be designed with a function of reversing banknotes in the face/back orientation so that the rejected proper banknotes and the rejected improper banknotes can be separated from each other by dispensing the rejected proper banknotes face-up while dispensing the rejected improper banknotes face-down. Alternatively, when dispensing rejected banknotes, the rejected proper banknotes and the rejected improper banknotes can be sorted into right and left side by side, or sorted by changing the direction of the long/short edges of the rejected proper banknotes from that of the rejected improper banknotes.

As described above, with the banknote handling technique according to the present invention, the rejected banknotes are sorted and dispensed based on the reject reason. Especially, with the banknote handling technique according to the present invention, because the rejected proper banknotes that can be properly handled after being reinserted and the rejected improper banknotes that would not be deposited even after being reinserted are separated from each other when they are dispensed, the efficiency of the rejected-banknote re-depositing task by the operator can be enhanced.

A rejected banknote having the reject reason due to a transport error should be properly handled simply by picking it up from the outlet and reinserting it. In the case of a rejected banknote having the reject reason due to a malfunction of the storing unit, the malfunction of the storing unit needs to be corrected before the reinsertion of the rejected banknote. Furthermore, for example, if the rejected proper banknote is a 1000-yen banknote and the rejected improper banknote is a counterfeit 1000-yen banknote, it can be difficult to determine at a glance which of the rejected banknotes is the rejected proper banknote.

In view of the above discussion, with the banknote handling technique according to the present invention, reject information that includes the reject reason for each of the rejected banknotes and a dispensing condition (e.g., dispensing destination) of each of the rejected banknotes is notified using a notification means such as a display unit and a speaker. In this manner, the operator who performs the re-depositing task can find that a malfunction in the storing unit needs to be corrected before reinsertion, and that where the rejected proper banknote that should be reinserted is dispensed, and the like. Therefore, the operator can efficiently perform the re-depositing task.

The reject information can be notified using the display unit or the speaker of the banknote handling apparatus, or can be notified from an operation terminal that is connected to the banknote handling apparatus. As the operation terminal, a terminal device (e.g., a personal computer) that mainly performs the operation control and status check of the banknote handling apparatus can be used. Also, an upper terminal (e.g., a server or a dedicated device) that is connected to a plurality of devices including the banknote handling apparatus and that controls each device and collects data from each device can be used. The upper terminal is used as an example of an operation terminal in the following embodiments.

As explained above, the rejected proper banknotes and the rejected improper banknotes are separated from each other, but the present invention is not limited thereto. In other words, as to the sorting of the rejected banknotes, the sorting method, by which what kind of the rejected banknotes is separated from what kind of the rejected banknotes, or the dispensing outlet, in which the rejected banknotes are dispensed, can be determined by the user such as the operator, as desired.

For example, the rejected proper banknotes can be further sorted and dispensed. In other words, the rejected proper banknotes whose reject reason is a transport error can be dispensed to the first outlet, while the rejected banknotes whose reject reason is a storage error can be dispensed to the second outlet. Similarly, the rejected improper banknotes can be further sorted and dispensed. In other words, the rejected improper banknotes such as counterfeit banknotes and unfit banknotes can be dispensed to the first outlet, while the rejected improper banknotes that are not included in the handling targets can be dispensed to the second outlet.

In the following description, exemplary embodiments of the banknote handling apparatus and the banknote handling method adopting the banknote handling technique explained with reference to FIGS. 1A to 1C are explained in detail. In the following explanation, a banknote handling apparatus that performs banknote depositing and dispensing transactions is discussed as an example of the banknote handling apparatus. The banknote handling apparatus according to the present invention, however, is also applicable to a banknote handling apparatus that performs a banknote depositing handling only.

First Embodiment

FIG. 2 is a diagram showing an entire structure of the banknote handling apparatus according to the first embodiment. As shown in FIG. 2, a banknote handling apparatus 1 according to the present embodiment includes a recognizing and counting unit 12, an inlet 11, an outlet 13, a deposit reject unit 14, an escrow unit 15, a transport unit 16, a transport-error detecting sensor 17, a storing unit 18, a stacking unit 19, and the like.

The recognizing and counting unit 12 recognizes banknotes that are transported by the transport unit 16. More specifically, the recognizing and counting unit 12 performs various determinations, such as denomination judgment, authenticity judgment, fitness judgment, and face/back judgment, on the banknotes transported by the transport unit 16. The recognizing and counting unit 12 also performs a process of counting the recognized banknotes in accordance with their denominations. The authenticity judgment means determining whether the banknotes are genuine or counterfeit, and the fitness judgment means determining whether the genuine banknotes are in a good condition (fit banknotes) or they are stained or torn (unfit banknotes).

The inlet 11 is a box with an opening thereof formed by shaping part of the top surface of the apparatus into a recess. The deposited banknotes are fed one by one to the transport unit 16 inside the apparatus by a feeding unit such as rollers arranged inside or near the box. The feeding of the deposited banknotes can be started manually or automatically.

The outlet 13 is a box with an opening thereof formed in a similar manner as the inlet 11. Banknotes for dispensing process are discharged from the inside of the apparatus in response to the dispensing instruction by the operator, and are stacked in the outlet 13. In the present embodiment, the outlet 13 is used as one of the dispensing destinations for the rejected banknotes.

The deposit reject unit 14 is an outlet in which rejected banknotes are stacked. In this manner, the banknote handling apparatus 1 according to the present embodiment has two outlets, the outlet 13 and the deposit reject unit 14, as the dispensing destinations for the rejected banknotes. The banknote handling apparatus 1 according to the present embodiment separates the rejected proper banknotes from the rejected improper banknotes. The rejected proper banknotes and the rejected improper banknotes are sorted by using these two outlets. This aspect will be described in detail later.

The escrow unit 15 is a box having an opening like the inlet 11 and the outlet 13. The escrow unit 15 is a storing and feeding unit that feeds-in the banknotes transported by the transport unit 16 to temporarily store them, and also feeds-out the escrowed banknotes. The escrow unit 15 switchbacks and returns the banknote transported by the transport unit 16 to the transport unit 16 so that the face/back orientation of the banknotes can be changed. The concrete structure and operation of the escrow unit 15 will be described later with reference to FIGS. 6A and 6B.

The transport unit 16 includes a conveyor belt and a driving unit for the conveyor belt. The banknote is transported, one by one, by being sandwiched from both sides, face-side and back-side. More specifically, the transport unit 16 connects the recognizing and counting unit 12, the inlet 11, the outlet 13, the deposit reject unit 14, the escrow unit 15, stackers 18*a* to 18*e* that are described later, a reconciliation cassette 18*f*, and the stacking unit 19 to one another via the conveyor belt, and transports the banknotes between these units.

The driving unit for the conveyor belt includes rollers to drive the conveyor belt, a path diverter arranged at each branch point of the transport unit 16, and the like. The path diverter swings between two positions, one is for transporting the banknotes transported by the transport unit 16 directly to the downstream side of the transport unit 16 and the other is for transporting the banknotes to the units (e.g., the outlet 13 and the deposit reject unit 14) connected to the transport unit 16, so that the banknotes can be dispensed to a desired location.

The transport-error detecting sensor 17 detects a banknote transport error such as skewed transport and chained transport. A plurality of transport-error detecting sensors 17 are arranged along the transport unit 16. The transport-error detecting sensor 17 detects that a banknote is in a skewed state when the banknote is inclined by an angle greater than or equal to a predetermined angle with respect to a transport direction, and that the banknotes are chained when distance between two consecutive banknotes is less than or equal to a predetermined distance. How the transport-error detecting sensor 17 specifically performs the detection will be discussed later with reference to FIGS. 5A and 5B.

The storing unit 18 has a plurality of stackers 18*a* to 18*e* in which the banknotes transported by the transport unit 16 are stored in accordance with their denominations, and the reconciliation cassette 18*f*. The stackers 18*a* to 18*e* are cassette-type storing units for storing the banknotes in accordance with their denominations. The stackers 18*a* to 18*e* include a feeding mechanism to feed the stored banknotes out to the transport unit 16. Each of the stackers 18*a* to 18*e* also includes an indicator such as a lamp that sends a storage error such as full state and malfunction.

In the present embodiment, it is assumed that the stacker 18*a* stores 1000-yen banknotes therein, the stacker 18*b* stores 2000-yen banknotes therein, the stacker 18*c* stores 5000-yen banknotes therein, and the stacker 18*d* stores 10000-yen banknotes therein. Meanwhile, the operator can assign any denomination to each of the stackers, as desired.

The reconciliation cassette 18*f* is a removable banknote cassette that is detachable from the banknote handling apparatus 1. The reconciliation cassette 18*f* is used to reconcile the number of banknotes stored in any of the stackers 18*a* to 18*e* when the number of banknotes in any one of the stackers 18*a* to 18*e* becomes uncertain due to a banknote jam or the like. The reconciliation cassette 18*f* stores banknotes therein, and also feeds the stored banknotes out to the transport unit 16, in the same manner as the stackers 18*a* to 18*e*.

Unlike the storing unit 18, the stacking unit 19 is only for storing banknotes therein. The stacking unit 19 stores sales proceeds therein, for example, at the close of business.

The banknote handling apparatus 1 according to the present embodiment is connected to a upper terminal 2 via a network 3 such as a Wide Area Network (WAN). The upper terminal 2 is a terminal device such as a server or a dedicated apparatus, and it controls the banknote handling apparatus 1. For example, the upper terminal 2 receives the recognition results and the counting results obtained by the recognizing and counting unit 12 via the network 3 and stores the results therein. The upper terminal 2 also includes a display unit, and can display the reject information onto the display unit upon receiving it from the banknote handling apparatus 1.

Figure 3:
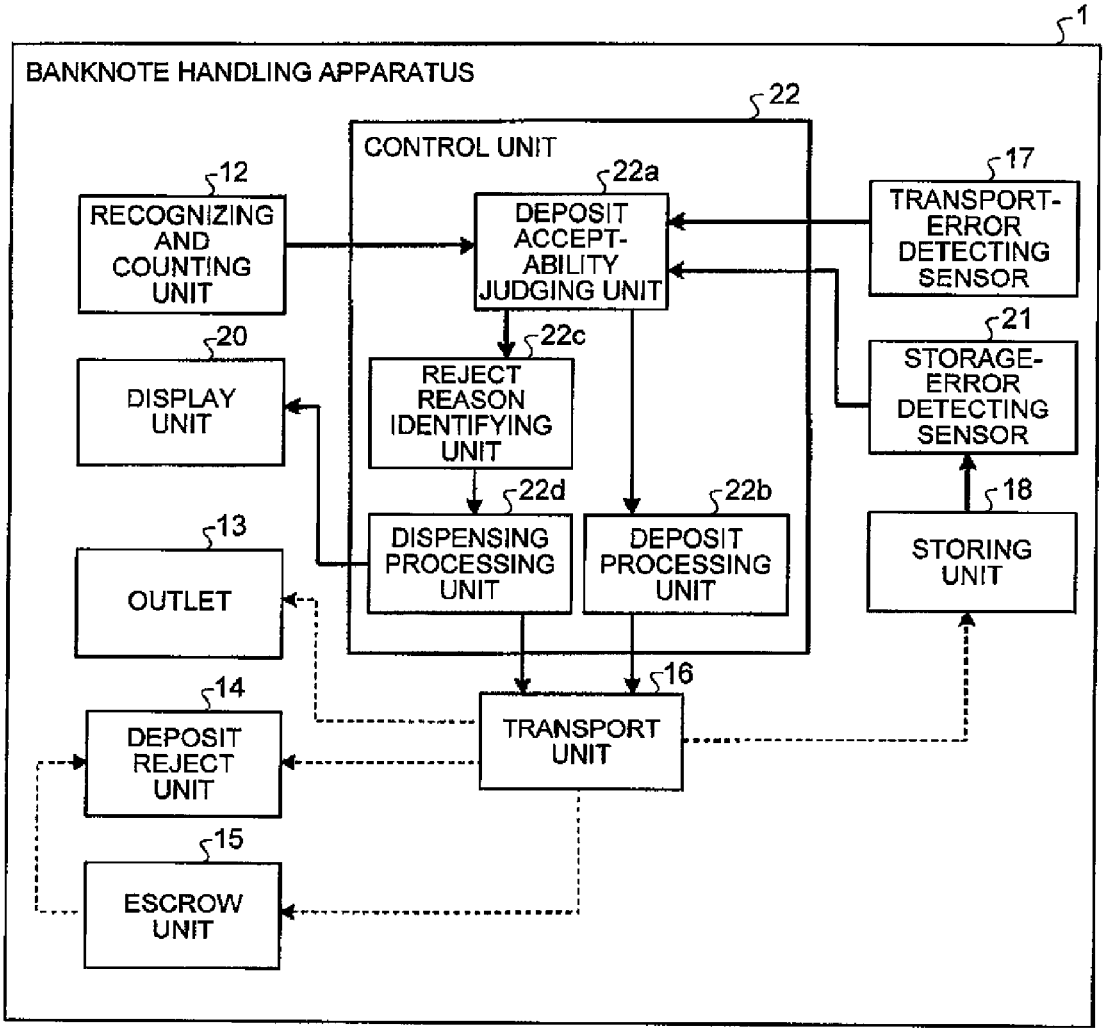
FIG. 3 is a block diagram showing a functional structure of the banknote handling apparatus according to the first embodiment.

Next, the functional structure of the banknote handling apparatus 1 according to the present embodiment is explained with reference to FIG. 3. FIG. 3 is a block diagram of the functional structure of the banknote handling apparatus 1 according to the present embodiment. The dotted lines shown in FIG. 3 indicate the flow of banknotes transported by the transport unit 16. In FIG. 3, only the structural elements that are necessary for explaining the features of the banknote handling apparatus 1 are shown, and general structural elements are omitted from the description.

As shown in FIG. 3, the banknote handling apparatus 1 according to the present embodiment includes the recognizing and counting unit 12, the outlet 13, the deposit reject unit 14, the escrow unit 15, the transport unit 16, the transport-error detecting sensor 17, the storing unit 18, the display unit 20, a storage-error detecting sensor 21, and a control unit 22. The control unit 22 includes a deposit acceptability judging unit 22*a*, a deposit processing unit 22*b*, a reject reason identifying unit 22*c*, and a dispensing processing unit 22*d*.

The recognizing and counting unit 12, the outlet 13, the deposit reject unit 14, the escrow unit 15, the transport unit 16, the transport-error detecting sensor 17, and the storing unit 18 have already been explained with reference to FIG. 2, and therefore the explanation thereof is omitted here.

The display unit 20 displays various types of information. For example, the reject information including a reject reason for each rejected banknote and the dispensing condition of each rejected banknote is displayed on the display unit 20. The dispensing condition of the rejected banknotes here indicates the dispensing destination of the rejected banknotes (e.g., the outlet 13 and the deposit reject unit 14) and a dispensing orientation of the rejected banknotes (e.g., long/short edge orientation).

The reject information does not always have to be displayed on the display unit 20 of the banknote handling apparatus 1, but it can be displayed on a display unit of the upper terminal 2 that is connected to the banknote handling apparatus 1. Furthermore, the recognition results and the counting results obtained by the recognizing and counting unit 12 can be displayed on the display unit 20 of the banknote handling apparatus 1 or the display unit of the upper terminal 2.

The storage-error detecting sensor 21 detects a storage error in the storing unit 18. The storage-error detecting sensor 21 is arranged in each of the stackers 18*a* to 18*e*. More specifically, the storage-error detecting sensor 21 detects the stackers 18*a* to 18*e* being full, as a storage error. The storage-error detecting sensor 21 also detects the corresponding stacker being unable to store any banknotes because of a banknote jam or the like, as a storage error.

The control unit 22 is a processing unit that executes processes such as deposit acceptability judgment, deposit process, reject reason identification, and dispensing process. The control unit 22 can be an integrated circuit such as an Application Specific Integrated Circuit (ASIC) and a Field Programmable Gate Array (FPGA), or an electronic circuit such as a Central Processing Unit (CPU) and a Micro Processing Unit (MPU).

The deposit acceptability judging unit 22*a* is a processing unit that determines whether the banknotes can be deposited, based on the recognition result obtained by the recognizing and counting unit 12.

For example, when the recognizing and counting unit 12 recognizes the banknote as a proper one, the deposit acceptability judging unit 22*a* judges that this banknote is acceptable for deposit, unless the storage-error detecting sensor 21 detects a storage error in one of the stackers 18*a* to 18*e* corresponding to the denomination of the recognized banknote. Upon judging that the banknote is acceptable for deposit, the deposit acceptability judging unit 22*a* sends the deposit processing unit 22*b* an execution instruction of deposit handling, together with denomination information of the banknote recognized by the recognizing and counting unit 12.

On the other hand, when the recognizing and counting unit 12 recognizes the banknote as a proper one, however the storage-error detecting sensor 21 detects a storage error in one of the stackers 18*a* to 18*e* corresponding to the denomination of the recognized banknote, the deposit acceptability judging unit 22*a* judges that the banknote is unacceptable for deposit. This is because the corresponding one of the stackers 18*a* to 18*e*, which is to store the recognized banknote, is not in a condition of storing any banknote.

Then, the deposit acceptability judging unit 22*a* sends the reject reason identifying unit 22*c* the recognition result obtained by the recognizing and counting unit 12 and a detection result obtained by the storage-error detecting sensor 21 regarding the rejected banknote.

Moreover, the deposit acceptability judging unit 22*a* judges that the deposit of this banknote is unacceptable if the denomination of this banknote is not the handling target, even when the recognizing and counting unit 12 recognizes the banknote as a proper one. Then, the deposit acceptability judging unit 22*a* sends the reject reason identifying unit 22*c* the recognition result obtained by the recognizing and counting unit 12 regarding this rejected banknote. The denomination that is not within the handling target can be, if the US dollar only is to be handled by this apparatus, any denomination other than the US dollar.

Moreover, when the recognizing and counting unit 12 recognizes the banknote as a counterfeit or unfit banknote or as an unrecognizable banknote, the deposit acceptability judging unit 22*a* judges that the banknote is unacceptable for deposit. Then, the deposit acceptability judging unit 22*a* sends the reject reason identifying unit 22*c* the recognition result obtained by the recognizing and counting unit 12 and the detection result obtained by the transport-error detecting sensor 17, regarding this rejected banknote. This is because the banknotes that are recognized as unrecognizable banknotes can include banknotes that are determined as unrecognizable because of a transport error such as skewed transport or chained transport.

The deposit processing unit 22*b* executes a process of depositing the banknotes in accordance with an instruction issued by the deposit acceptability judging unit 22*a*. More specifically, when the execution instruction of the deposit process is received from the deposit acceptability judging unit 22*a*, the deposit processing unit 22*b* drives the path diverter of the transport unit 16 and thereby stores the banknotes into the stackers 18*a* to 18*e* based on the denominations recognized by the recognizing and counting unit 12.

The reject reason identifying unit 22*c* is a processing unit that identifies the reject reason of the rejected banknote which is judged by the deposit acceptability judging unit 22*a* as being unacceptable for deposit.

More specifically, the reject reason identifying unit 22*c* receives the recognition result obtained by the recognizing and counting unit 12 and the detection result obtained by the storage-error detecting sensor 21, regarding the rejected banknote, from the deposit acceptability judging unit 22*a*. Then, if the received information indicates that the rejected banknote is a proper banknote and also that one of the stackers 18*a* to 18*e* corresponding to the denomination of the rejected banknote shows a storage error, the reject reason identifying unit 22*c* identifies that the reject reason of the rejected banknote is a storage error.

Moreover, the reject reason identifying unit 22*c* receives the recognition result obtained by the recognizing and counting unit 12 and the detection result obtained by the transport-error detecting sensor 17, regarding the rejected banknote, from the deposit acceptability judging unit 22*a*. When the received information indicates that the rejected banknote is an unrecognizable banknote and also that the transporting condition of the rejected banknote shows an error, the reject reason identifying unit 22*c* identifies that the reject reason of the rejected banknote is a transport error.

Furthermore, the reject reason identifying unit 22*c* receives the recognition result obtained by the recognizing and counting unit 12 regarding the rejected banknote, from the deposit acceptability judging unit 22*a*. When the received information indicates that the denomination of the rejected banknote is not within the handling target, the reject reason identifying unit 22*c* identifies that the reject reason of the rejected banknote is its denomination not being included in the handling target.

Thereafter, the reject reason identifying unit 22*c* sends the dispensing processing unit 22*d* the identified reject reason and the dispensing instruction of the rejected banknote.

Upon receiving the dispensing instruction from the reject reason identifying unit 22*c*, the dispensing processing unit 22*d* sorts and dispenses the rejected banknotes, based on the reject reason identified by the reject reason identifying unit 22*c*.

Figure 4A:
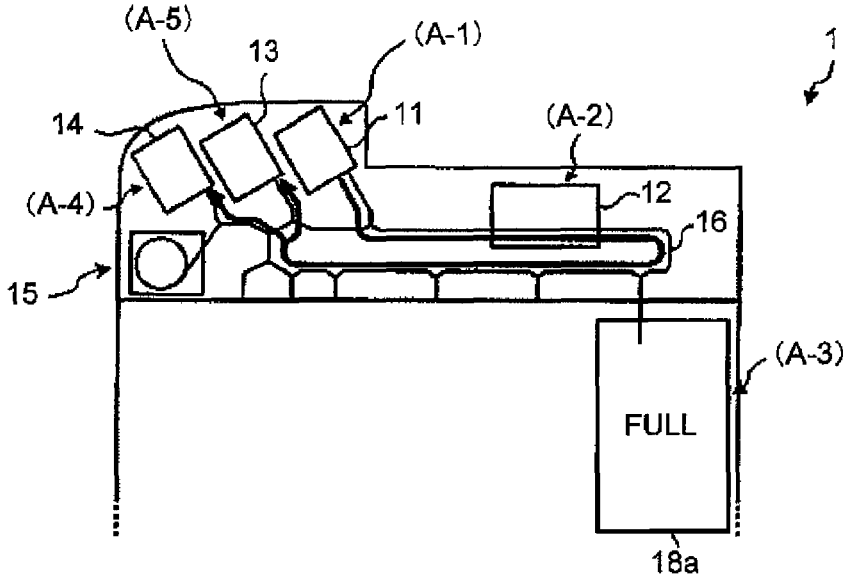
FIGS. 4A to 4C are diagrams showing an operation example of determining a dispensing destination for banknotes rejected due to a storage error.
Figure 4B:
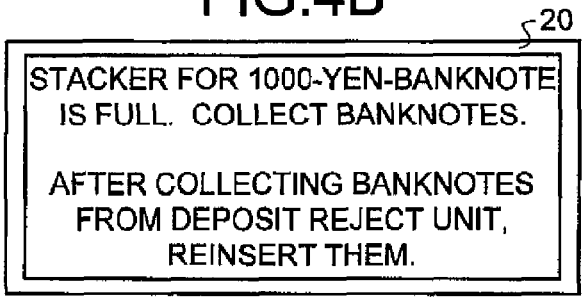
Figure 4C:
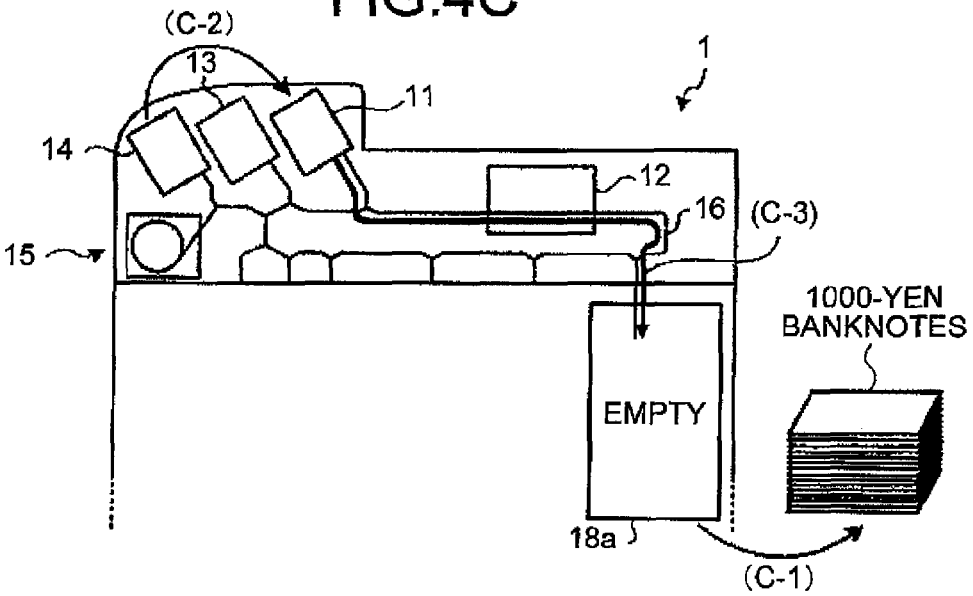

An operation example of the dispensing process performed by the dispensing processing unit 22*d* is explained below. First, an operation example of changing the dispensing destinations of the banknotes that are rejected due to a storage error is explained with reference to FIGS. 4A to 4C. FIGS. 4A to 4C are diagrams showing an operation example of changing the dispensing destinations of the banknotes that are rejected due to a storage error.

In FIGS. 4A to 4C, an example of a storage error caused in the 1000-yen stacker 18*a* is explained. As shown in FIGS. 4A to 4C, the banknotes rejected due to the storage error are 1000-yen banknotes. An operation example of the dispensing processing unit 22*d* is shown in FIG. 4A, an example of the display of the reject information is shown in FIG. 4B, and the reinserting of the banknotes rejected due to the storage error is shown in FIG. 4C.

As shown in FIG. 4A, a plurality of banknotes including 1000-yen banknotes are inserted into the inlet 11 (see (A-1) of FIG. 4A). In such a situation, in the banknote handling apparatus 1, the recognizing and counting unit 12 recognizes and counts the banknotes one by one that are inserted into the inlet 11 (see (A-2) of FIG. 4A), and the deposit acceptability judging unit 22*a* judges the deposit acceptability of the banknotes, based on the recognition results.

In the banknote handling apparatus 1, when the deposit acceptability judging unit 22*a* judges that the banknotes is acceptable for deposit, the deposit processing unit 22*b* stores these banknotes into any one of the stackers 18*a* to 18*e* in accordance with their denominations (not shown).

On the other hand, in the banknote handling apparatus 1, when the deposit acceptability judging unit 22*a* judges that the banknotes is unacceptable for deposit, the reject reason identifying unit 22*c* identifies the reject reason of the rejected banknotes. When the banknotes recognized by the recognizing and counting unit 12 are 1000-yen banknotes, and also when the storage-error detecting sensor 21 detects that the 1000-yen banknote stacker 18*a* is full (see (A-3) of FIG. 4A), the reject reason identifying unit 22*c* identifies that the reject reason of these 1000-yen banknotes is a storage error.

Thereafter, in the banknote handling apparatus 1, the rejected banknotes (which are the 1000-yen banknotes) whose reject reason identified by the reject reason identifying unit 22*c* is a storage error are dispensed to the deposit reject unit (see (A-4) of FIG. 4A). The rejected banknotes whose reject reason is anything other than the storage error (such as unfit banknotes) are dispensed to the outlet 13 (see (A-5) of FIG. 4A).

In this manner, the 1000-yen banknotes that are rejected due to the storage error are dispensed to a dispensing destination that is different from a dispensing destination for banknotes rejected due to any other reject reasons.

Next, as shown in FIG. 4B, the dispensing processing unit 22*d* displays the reject information onto the display unit 20. For example, the dispensing processing unit 22*d* displays, as the reject information, information such as "1000-yen banknote stacker is full. Collect banknotes." and "After collecting banknotes from deposit reject unit, Reinsert them." onto the display unit 20. As described above, the reject information includes the reject reason identified by the reject reason identifying unit 22*c* and a dispensing condition including dispensing destination information of the rejected banknotes.

Then, the operator can perform the rejected banknote re-depositing task in accordance with the reject information displayed on the display unit 20. More specifically, as shown in FIG. 4C, the operator collects the banknotes from the stacker 18*a* corresponding to 1000-yen banknotes (see (C-1) of FIG. 4C), and then removes the 1000-yen banknotes discharged to the deposit reject unit 14 and reinserts them into the inlet 11 (see (C-2) of FIG. 4C). As a result, the 1000-yen banknotes that are reinserted into the inlet 11 is judged by the deposit acceptability judging unit 22*a* as being acceptable for deposit, and the banknotes are stacked into the 1000-yen banknote stacker 18*a* (see (C-3) of FIG. 4C).

When collecting the banknotes from the corresponding one of the stackers 18*a* to 18*e* that is full, or when replacing the faulty one of the stackers 18*a* to 18*e*, the operator can easily learn which of the stackers 18*a* to 18*e* brings a storage error by simply checking the indicator arranged in each of the stackers 18*a* to 18*e*. Furthermore, the storage error in the stackers 18*a* to 18*e* does not always have to be notified by an indicator, but can be notified by using the upper terminal 2 that is connected to the banknote handling apparatus 1.

In this manner, when the recognizing and counting unit 12 recognizes that the rejected banknotes are proper ones, and also when the storage-error detecting sensor 21 detects an error in the storing unit 18 that corresponds to the denomination of the rejected banknotes, the reject reason identifying unit 22*c* identifies that the reject reason of the rejected banknotes is a storage error, and the dispensing processing unit 22*d* dispenses the rejected banknotes, whose reject reason is identified as the storage error, by separating them from the rejected banknotes that have other reject reasons. Accordingly, the re-depositing task can be efficiently performed for the rejected banknotes which have been determined to be unacceptable for deposit due to an error in the storing unit, even though they are proper banknotes.

Moreover, the dispensing processing unit 22*d* notifies of the reject reason identified by the reject reason identifying unit 22*c* together with the dispensing condition including the dispensing destination information of the rejected banknotes using a predetermined notification unit, and thus the re-depositing task of the rejected banknotes can be performed further efficiently.

In FIG. 4B, the display of only the reject information of the banknotes rejected due to the storage error has been explained. However, additionally the dispensing processing unit 22*d* can display the reject information regarding other rejected banknotes. Moreover, the dispensing processing unit 22*d* can display such reject information onto the display unit of the upper terminal that is connected via the network 3.

Figure 5A:
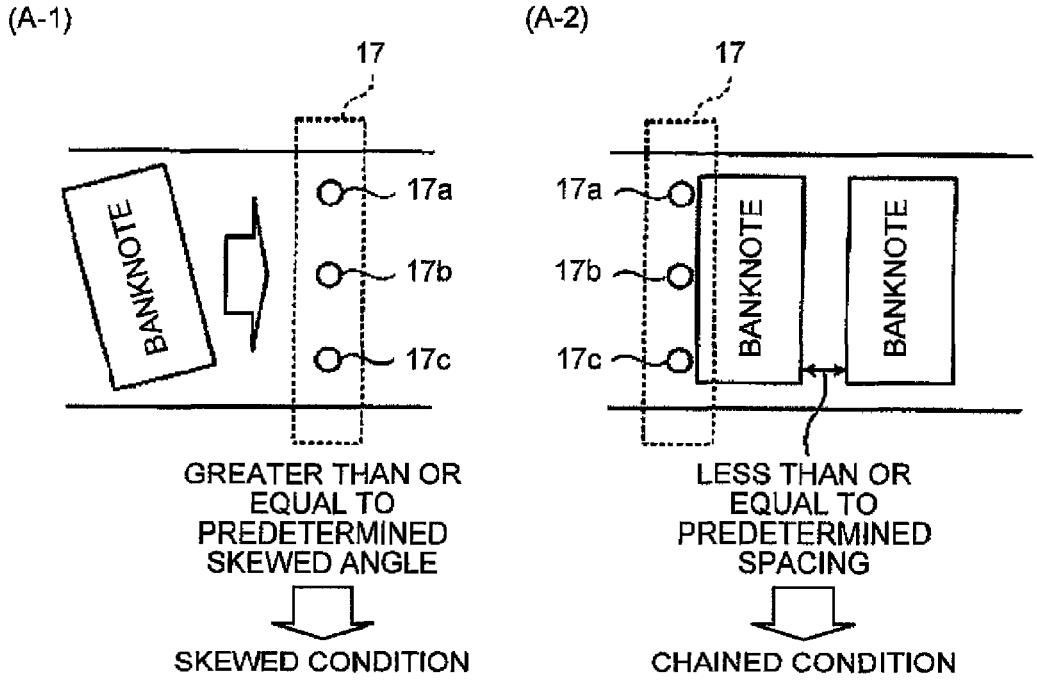
FIGS. 5A and 5B are diagrams showing an operation example of determining a dispensing destination for banknotes rejected due to a transport error.
Figure 5B:
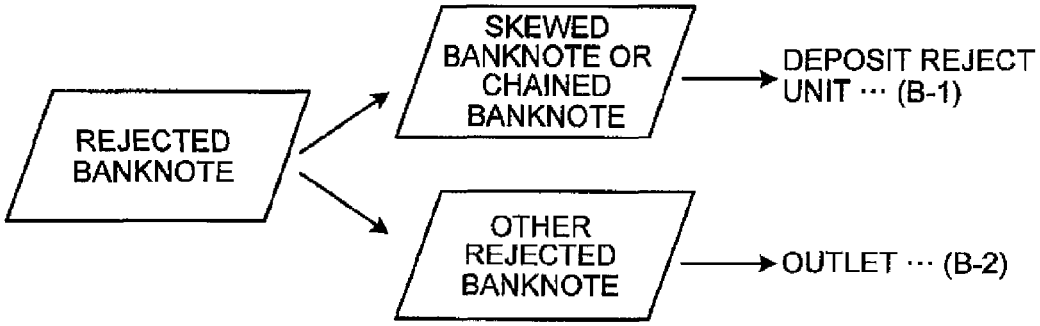

Thereafter, an operation example performed when changing the dispensing destinations of the banknotes rejected due to a transport error is explained with reference to FIGS. 5A and 5B. FIGS. 5A and 5B are diagrams showing an operation example of changing the dispensing destinations of the banknotes rejected due to a transport error. The detecting technique adopted by the transport-error detecting sensor 17 is shown in FIG. 5A, and an operation example of the dispensing processing unit 22*d* is shown in FIG. 5B.

As shown in FIG. 5A, the transport-error detecting sensor 17 includes a plurality of sensors 17*a* to 17*c* arranged in a direction orthogonal to the transport direction of the transport unit 16. The transport-error detecting sensor 17 detects a transport error such as skewed transport of banknotes or chained banknotes using these sensors 17*a* to 17*c*.

For example, as shown in (A-1) of FIG. 5A, the transport-error detecting sensor 17 calculates the inclination of a banknote by observing the time variation in the detection results obtained by the sensors 17*a* to 17*c* when the banknote passes any of the sensors 17*a* to 17*c*. When the calculated inclination of the banknote is greater than or equal to the predetermined angle, the transport-error detecting sensor 17 detects that the banknote is in the skewed state.

As shown in (A-2) of FIG. 5A, the transport-error detecting sensor 17 calculates a distance between two banknotes based on a time period from the sensors 17*a* to 17*c* detecting a banknote until the sensors 17*a* to 17*c* detecting the next banknote. When the calculated distance is less than or equal to the predetermined distance, the transport-error detecting sensor 17 detects that the banknotes are chained. For example, the transport-error detecting sensor 17 detects that the banknotes are in the chained state when the distance between the banknotes is less than or equal to 60 millimeters (mm).

In this manner, the transport-error detecting sensor 17 detects the skewed transport of the banknotes when the banknotes are inclined by an angle greater than or equal to the predetermined angle with respect to the transport direction, and detects the chained banknotes when the distance between one banknote and another banknote is less than or equal to the predetermined distance.

On the other hand, when the recognizing and counting unit 12 recognizes the rejected banknotes as unrecognizable banknotes, and also when the transport-error detecting sensor 17 detects a transport error in the rejected banknotes, the reject reason identifying unit 22*c* identifies that the reject reason of the rejected banknote is a transport error.

As shown in FIG. 5B, the dispensing processing unit 22*d* dispenses the rejected banknotes whose reject reason is identified as the transport error by the reject reason identifying unit 22*c*, to the deposit reject unit 14 (see (B-1) of FIG. 5B). The rejected banknotes whose reject reason is anything other than the transport error are dispensed to the outlet 13 (see (B-2) of FIG. 5B).

In this manner, when the recognizing and counting unit 12 recognizes the rejected banknotes as improper ones, and also when the transport-error detecting sensor 17 detects a transport error in the rejected banknotes, the reject reason identifying unit 22*c* identifies the reject reason as the transport error. The dispensing processing unit 22*d* separates the rejected banknotes, whose reject reason is identified as the transport error, from the rejected banknotes, whose reject reason is anything other than the transport error, and sorts them. Accordingly, a task of re-depositing the rejected banknotes which are determined to be unacceptable for deposit, by chance, due to a transport error such as skewed transport and chained transport can be performed efficiently.

As explained with reference to FIGS. 4A to 4C and FIGS. 5A and 5B, the dispensing processing unit 22*d* dispenses first rejected banknotes whose reject reason corresponds to a predetermined reject reason (e.g., rejected proper banknotes) to one outlet, and second rejected banknotes whose reject reason does not correspond to the predetermined reject reason (e.g., rejected improper banknotes) to another outlet. Accordingly, the rejected proper banknotes, which are likely to be accepted for deposit when reinserting, and the rejected improper banknotes, which would not be accepted for deposit no matter how many times they are inserted, are dispensed to different outlets. Therefore the task of re-depositing the rejected proper banknotes can be performed efficiently.

The rejected banknotes that are sorted by using a plurality of outlets and assigning the rejected banknotes to any one of the outlets to dispense are explained so far; however, the present embodiment is not limited thereto. For example, the dispensing processing unit 22*d* can sort and dispense the rejected banknotes even if there is only one outlet. This configuration is explained below.

First, the sorting of the rejected banknotes by changing the face/back orientation of the rejected banknotes and dispensing them is explained. In such a situation, the dispensing processing unit 22*d* uses the escrow unit 15 to change the face/back orientation of the rejected banknotes to perform the dispensing process.

Figure 6A:
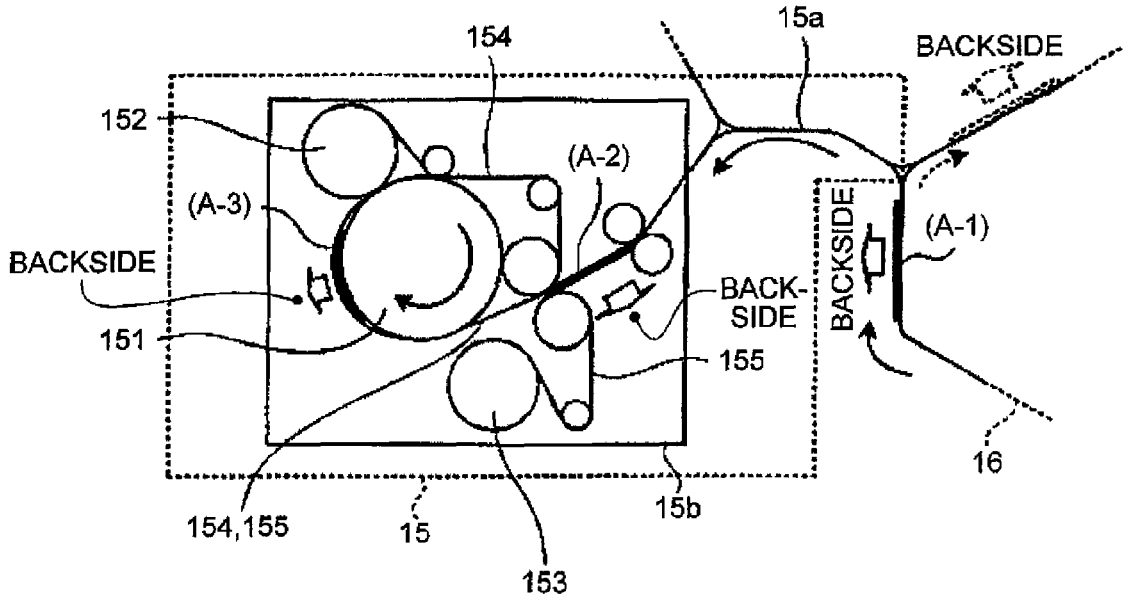
FIGS. 6A and 6B are diagrams showing an operation example of a face/back reversing process performed by an escrow unit.
Figure 6B:
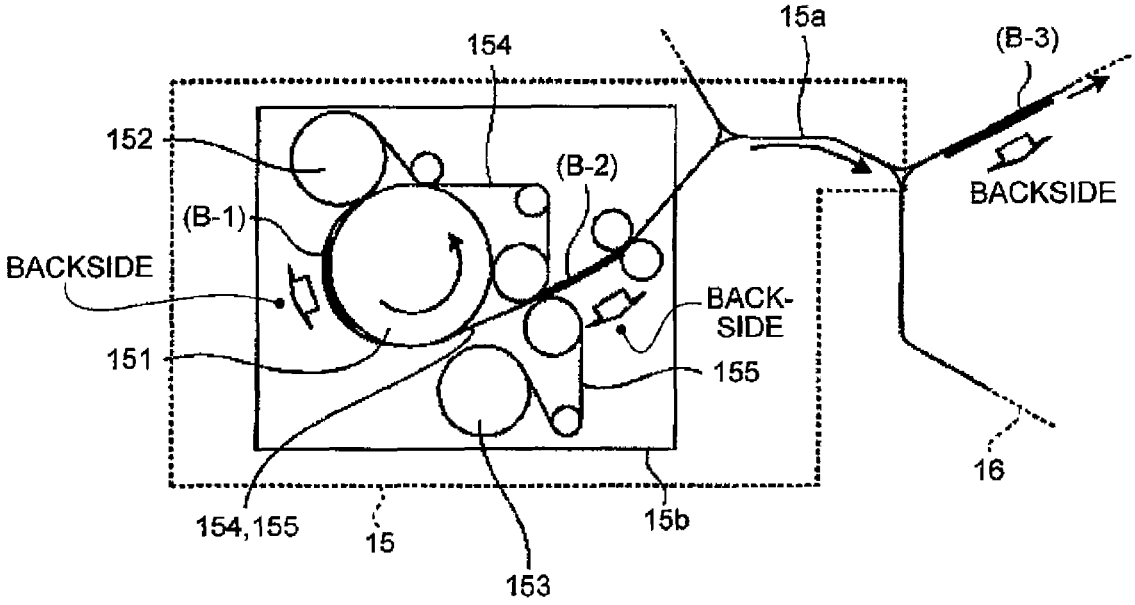

An operation example of the escrow unit 15 in a face/back reversing process is explained with reference to FIGS. 6A and 6B. FIGS. 6A and 6B are diagrams showing an operation example of the escrow unit in the face/back reversing process. An operation example when feeding the banknotes into the escrow unit 15 is shown in FIG. 6A, and an operation example when feeding the banknotes from the escrow unit 15 is shown in FIG. 6B.

As shown in FIG. 6A, the escrow unit 15 includes a switchback path 15*a* and a tape-type winding unit 15*b*. The switchback path 15*a* branches out from the transport unit 16, and connects the transport unit 16 and the tape-type winding unit 15*b* to each other. The banknote transported by the transport unit 16 is carried onto the switchback path 15*a*, and then fed back again (in other words, switched back) to the transport unit 16 so that it is returned to the transport unit 16 with their face/back orientation changed. The switchback path 15*a* also connects the transport unit 16 and the deposit reject unit 14 to each other.

The tape-type winding unit 15*b* includes a rotary drum 151, an upper pulley 152, a lower pulley 153, and tapes 154 and 155. The rotary drum 151 is a rotary member that is axially supported in such a manner as to rotate forward and backward. The two tapes 154 and 155 are wound around the rim of the rotary drum 151. Of the two tapes 154 and 155, the upper pulley 152 reels up the tape 154, while the lower pulley 153 reels up the tape 155.

When the banknotes are escrowed in the tape-type winding unit 15*b*, the rotary drum 151 rotates forward (in the direction of the arrow illustrated in FIG. 6A), winds and holds the banknotes fed via the switchback path 15*a* around the rim of the rotary drum 151 by sandwiching them between the tapes 154 and 155 (see (A-1) to (A-3) of FIG. 6A).

On the other hand, when the banknotes are fed out of the tape-type winding unit 15*b*, as shown in FIG. 6B, the rotary drum 151 rotates backward (in the direction of the arrow shown in FIG. 6B), feeds the banknotes that are sandwiched between the tapes 154 and 155 out to the switchback path 15*a*. The banknotes fed out to the switchback path 15*a* by the tape-type winding unit 15*b* are returned to the transport unit 16 with their face/back orientation changed with respect to the one that was when feeding in the banknotes from the transport unit 16 (see (B-1) to (B-3) of FIG. 6B).

In this manner, the escrow unit 15 uses the tape-type winding unit 15*b* and escrows the banknotes fed onto the switchback path 15*a*. The escrow unit 15 also switches the escrowed banknotes back and returns them to the transport unit 16 so that the face/back orientation of the banknotes can be changed.

Figure 7A:
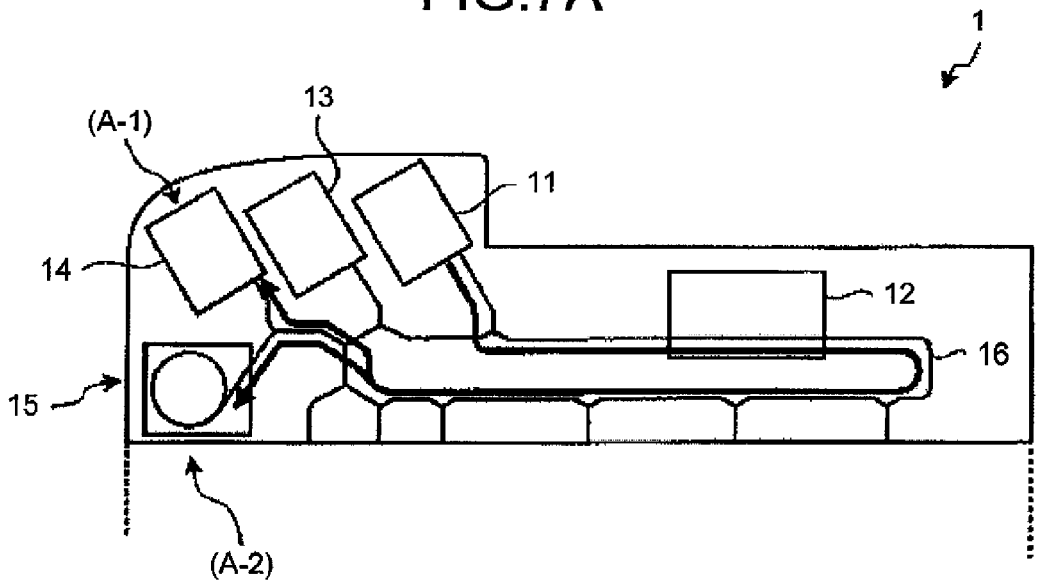
FIGS. 7A and 7B are diagrams showing an operation example of sorting the rejected banknotes using the escrow unit.
Figure 7B:
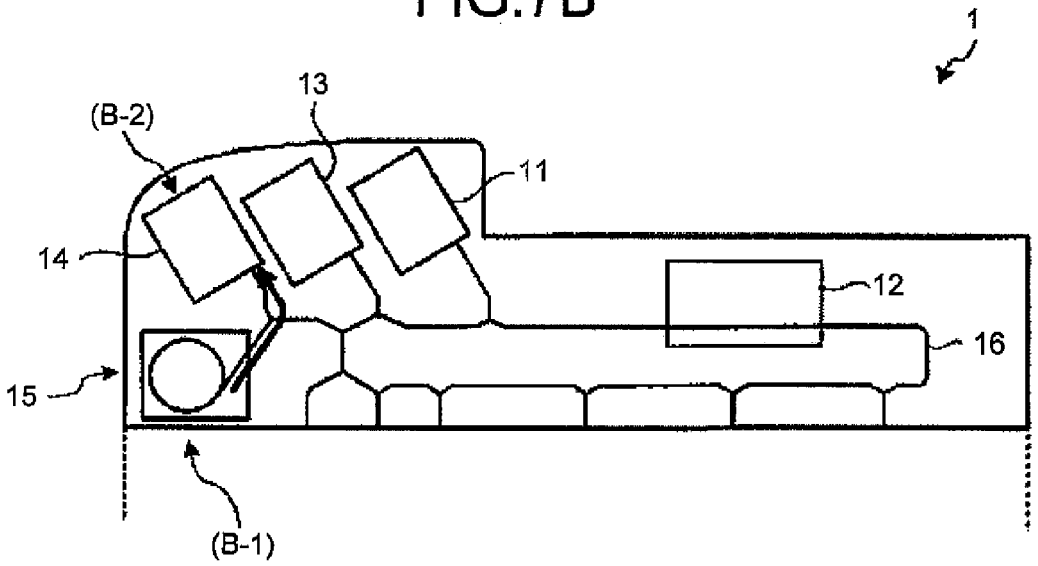

Next, the operation of sorting the rejected banknotes using the escrow unit 15 is explained with reference to FIGS. 7A and 7B. FIGS. 7A and 7B are diagrams showing an operation example of sorting the rejected banknotes using the escrow unit 15.

As shown in FIGS. 7A and 7B, an example is explained in which the rejected proper banknotes, whose reject reason is identified by the reject reason identifying unit 22*c* as the transport error or the storage error, are dispensed face-up, and other rejected improper banknotes are dispensed face-down, to the deposit reject unit. An operation example of the dispensing processing unit 22*d* is shown in FIG. 7A, and the operation performed by the escrow unit 15 is shown in FIG. 7B.

As shown in FIG. 7A, the dispensing processing unit 22*d* dispenses the rejected proper banknotes that are judged by the recognizing and counting unit 12 as being placed face-up, to the deposit reject unit 14. Similarly, the dispensing processing unit 22*d* dispenses the rejected improper banknotes judged by the recognizing and counting unit 12 as being placed face-down, also to the deposit reject unit 14 (see (A-1) of FIG. 7A).

Moreover, the dispensing processing unit 22*d* escrows the rejected proper banknotes that are judged by the recognizing and counting unit 12 as being placed face-down, using the escrow unit 15. Similarly, the dispensing processing unit 22*d* also escrows the rejected improper banknotes that are judged by the recognizing and counting unit 12 as being placed face-up, using the escrow unit 15 (see (A-2) of FIG. 7A).

Thereafter, in the banknote handling apparatus 1, the escrow unit 15 reverses the escrowed rejected proper banknotes and rejected improper banknotes in the face/back orientation, and feeds them out to the deposit reject unit 14 (see (B-1) of FIG. 7B). In this manner, the rejected proper banknotes that are escrowed by the escrow unit 15 are reversed and dispensed to the deposit reject unit 14 as being placed face-up. Similarly, the rejected improper banknotes that are escrowed by the escrow unit 15 are also reversed and dispensed to the deposit reject unit 14 as being placed face-down (see (B-2) of FIG. 7B).

As a result, when stacking in the deposit reject unit 14, the rejected proper banknotes are face-up while the rejected improper banknotes are face-down.

In this manner, the dispensing processing unit 22*d* determines that the first rejected banknotes (e.g., the rejected proper banknotes) are dispensed in either face-up orientation or face-down orientation and that the second rejected banknotes (e.g., the rejected improper banknotes) are dispensed in the orientation opposite to that of the first rejected banknotes. When the face/back orientation recognized by the recognizing and counting unit 12 is different from the face/back orientation determined by the dispensing processing unit 22*d*, the escrow unit 15 reverses the face/back orientation of the rejected banknotes and then dispenses these rejected banknotes.

Hence, the rejected proper banknotes that are likely to be deposited by reinserting and the rejected improper banknotes that cannot be deposited no matter how many times they are reinserted are dispensed in different orientations, and therefore the task of re-depositing the rejected proper banknotes can be performed efficiently.

The escrow unit 15 is used to reverse the face/back orientation; however, the escrow unit 15 can be used to escrow the rejected banknotes. For example, all the rejected proper banknotes can be escrowed in the escrow unit 15, and all the rejected improper banknotes can be dispensed to the deposit reject unit 14. Thereafter, the rejected proper banknotes that are escrowed in the escrow unit 15 can be dispensed to the deposit reject unit 14. In this manner, the rejected proper banknotes and the rejected improper banknotes can be separated and dispensed by changing their dispensing order.

In addition, the rejected banknotes are described here as being dispensed to the deposit reject unit 14; however, the dispensing destination is not limited thereto. The rejected banknotes can be dispensed to the outlet 13, or to both of the deposit reject unit 14 and the outlet 13. Moreover, the rejected banknotes can be escrowed using the escrow unit 15, and after all the banknotes in the inlet 11 are fed, the rejected banknotes that are escrowed in the escrow unit 15 can be dispensed to the inlet 11.

Figure 8A:
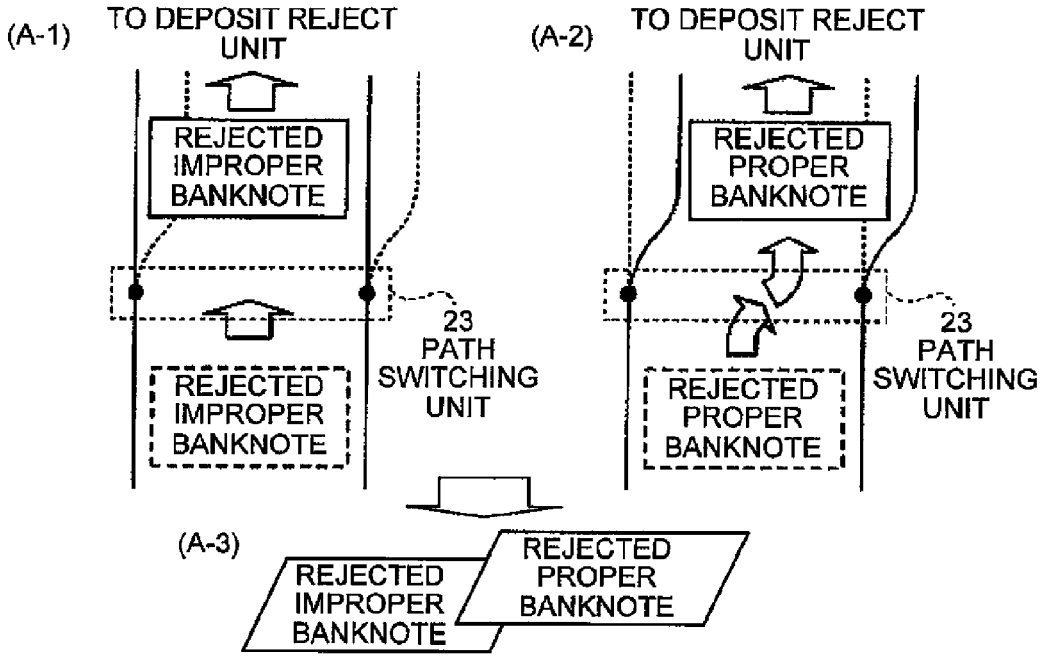
FIGS. 8A and 8B are diagrams showing another operation example of a dispensing processing unit.
Figure 8B:
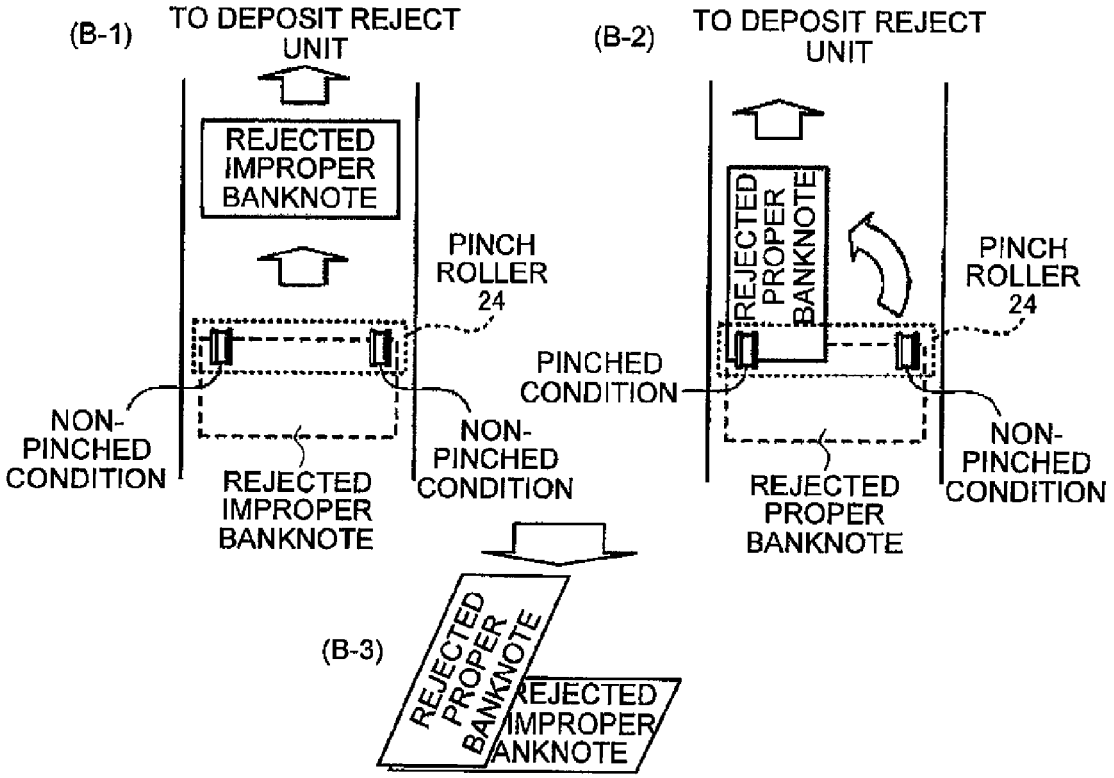

Next, the rejected banknotes that are sorted by dispensing them in such a manner as to be shifted in a horizontal direction or to have different orientations with regard to the long/short edges are explained with reference to FIGS. 8A and 8B. FIGS. 8A and 8B are diagrams showing other operation examples of the dispensing processing unit 22*d*. An operation example of dispensing the rejected banknotes by horizontally shifting them is shown in FIG. 8A, while an operation example of dispensing the rejected banknotes by changing the orientation of the short/long edges is shown in FIG. 8B.

As shown in FIG. 8A, a path switching unit 23 is arranged on the transport unit 16 near the deposit reject unit 14 to shift the banknotes being transported in a direction orthogonal to the transport direction (i.e., the side-to-side direction).

The path switching unit 23 enables the rejected proper banknotes (see (A-1) of FIG. 8A) and the rejected improper banknotes (see (A-2) of FIG. 8A) to be shifted in the side-to-side direction from each other and collected in the deposit reject unit 14 (see (A-3) of FIG. 8A).

As shown in FIG. 8B, a pinch roller 24 can be arranged on the transport unit 16 near the deposit reject unit 14 to turn the banknotes around by switching between a pinched state and a non-pinched state.

By using this pinch roller 24, the rejected proper banknotes (see (B-2) of FIG. 8B) and the rejected improper banknotes (see (B-1) of FIG. 8B) can be stacked in the deposit reject unit 14 with the long/short edge orientations thereof different from each other (see (B-3) of FIG. 8B).

In this manner, the rejected banknotes can be sorted by shifting in the side-to-side direction or changing the long/short edge orientations of the rejected banknotes.

Alternatively, the banknote handling apparatus 1 can include a printing unit on the transport unit 16 to print predetermined letters onto the rejected improper banknotes only, and then dispense the banknotes. In this manner, the rejected proper banknotes and the rejected improper banknotes can be sorted and dispensed. With this configuration, the reject reason can be printed onto the rejected improper banknotes so that whether the rejected improper banknotes are, for example, counterfeit banknotes or unfit banknotes can be easily understood.

Figure 9:
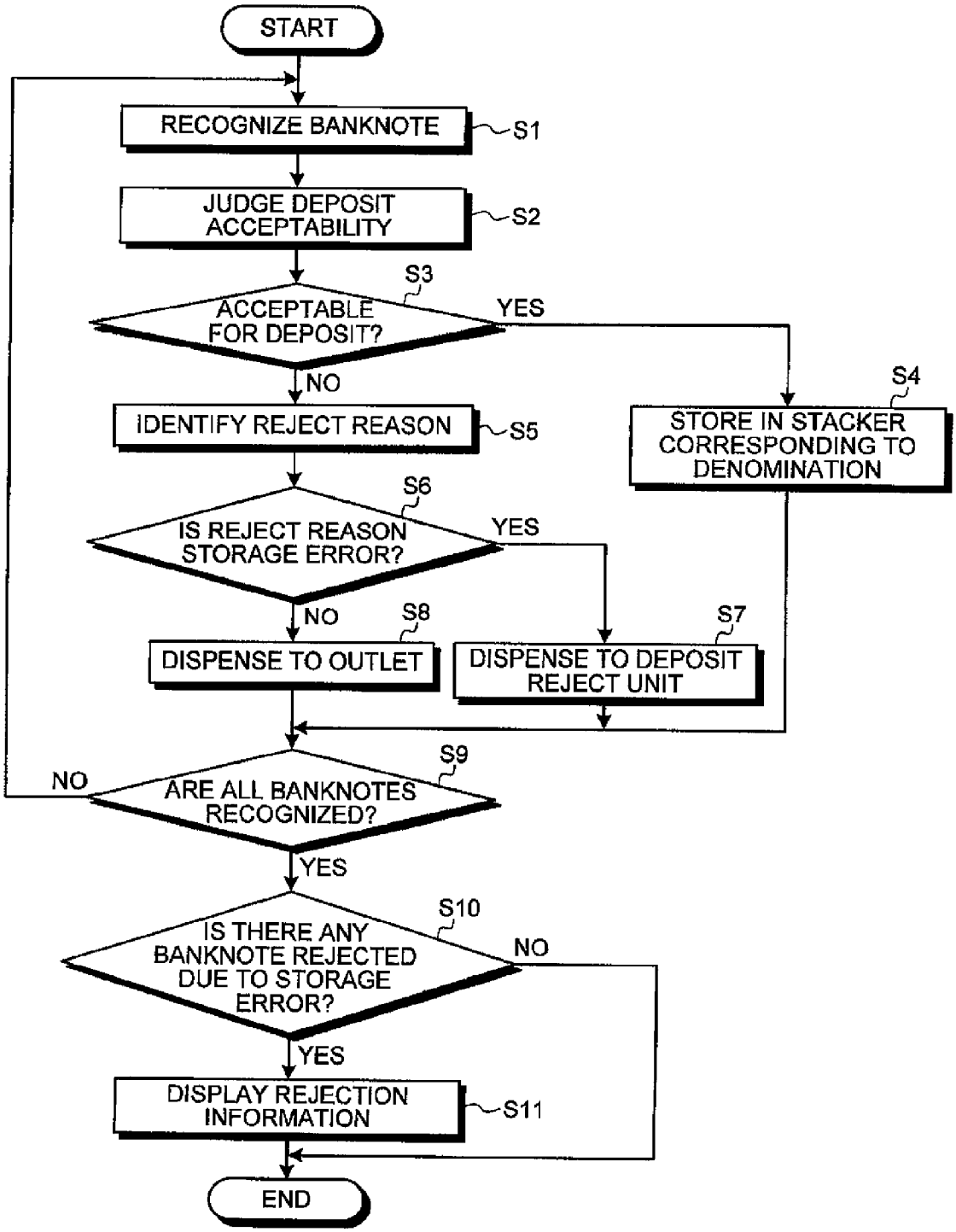
FIG. 9 is a flowchart of the process procedure performed by the banknote handling apparatus according to the present embodiment.

Next, a specific operation of the banknote handling apparatus 1 according to the present embodiment is explained with reference to FIG. 9. FIG. 9 is a flowchart of the process procedure performed by the banknote handling apparatus 1 according to the present embodiment. As shown in FIG. 9, an example is explained in which the banknotes that are rejected due to a storage error are separated from other rejected banknotes, and then dispensed accordingly.

As shown in FIG. 9, in the banknote handling apparatus 1 according to the present embodiment, when the recognizing and counting unit 12 executes a banknote recognition process (Step S1), the deposit acceptability judging unit 22*a* judges the deposit acceptability (Step S2). Thereafter, in the banknote handling apparatus 1, upon the deposit acceptability judging unit 22*a* judging that the banknotes is acceptable for deposit (Yes at Step S3), the deposit processing unit 22*b* stores the banknotes into the stackers 18*a* to 18*e* corresponding to their denomination based on the recognition results (Step S4).

On the other hand, in the banknote handling apparatus 1, when the deposit acceptability judging unit 22*a* judges that the banknotes is unacceptable for deposit (No at Step S3), the reject reason identifying unit 22*c* identifies the reject reason of the rejected banknotes (Step S5).

Thereafter, in the banknote handling apparatus 1, the reject reason identifying unit 22*c* determines whether the reject reason is a storage error (Step S6), and upon judging that the reject reason is a storage error (Yes at Step S6), the dispensing processing unit 22*d* dispenses these rejected banknotes to the deposit reject unit 14 (Step S7).

On the other hand, when the reject reason is not a storage error (No at Step S6), the dispensing processing unit 22*d* dispenses those rejected banknotes to the outlet 13 (Step S8).

After the operation at Step S4, S7, or S8 is completed, it is determined in the banknote handling apparatus 1 whether all the banknotes inserted into the inlet 11 are already recognized (Step S9), and if not (No at Step S9), the operations of Steps S1 through S9 are repeated.

On the other hand, when the banknote handling apparatus 1 determines that all the banknotes inserted into the inlet 11 are already recognized (Yes at Step S9), it determines whether the inserted banknotes include any banknotes that are rejected due to a storage error (Step S10). Thereafter, in the banknote handling apparatus 1, if it is determined that there are banknotes rejected due to a storage error (Yes at Step S10), the reject information is displayed onto the display unit 20 (Step S11), and the process is terminated. In the banknote handling apparatus 1, when there is no banknote rejected due to a storage error (No at Step S10), the process is terminated as it is.

As described above, according to the present embodiment, the recognizing and counting unit recognizes the inserted banknotes, the deposit acceptability judging unit judges the deposit acceptability of the banknotes based on the banknote recognition result obtained by the recognizing and counting unit, the reject reason identifying unit identifies the reject reason for the rejected banknotes which are judged as being unacceptable for deposit by the deposit acceptability judging unit, and the dispensing processing unit sorts and dispenses the rejected banknotes based on the reject reason identified by the reject reason identifying unit. Thus, the rejected banknote re-depositing task can be performed efficiently.

In FIG. 9, the reject information is displayed only when there are any banknotes rejected due to a storage error; however, the display of the reject information is not limited thereto. The reject information can be displayed whenever there are rejected banknotes.

In the above embodiment, the escrow unit 15 is used as an example of the face/back reversing unit; however, the face/ back reversing unit is not limited thereto. Any of the stackers 18*a* to 18*e* can be used as the face/back reversing unit.

In the above embodiment, the tape-type winding unit 15*b* that is a tape-type storing unit is used to escrow the banknotes and feed them back to the transport unit 16. However, any type can be used as long as it can feed the escrowed banknotes back. For example, a stacker-type storing unit similar to the stackers 18*a* to 18*e* can be used.

A technology is known to the inventor in which, when the banknote handling apparatus 1 is recovered from a failure such as a jam or a malfunction of the transport unit 16 or when maintenance checks or the like are performed on the transport unit 16, whether there is any remaining banknote or whether there is any malfunction in the transport unit 16 can be determined by inserting a banknote or a test banknote to transport around on the transport unit 16.

As shown in FIG. 2, the transport unit 16 in the banknote handling apparatus 1 according to the present embodiment is loop-shaped. Therefore, in the banknote handling apparatus 1 according to the present embodiment, the transporting state of the transport unit 16 and the like can be statistically judged, not by transporting a banknote or a test banknote just for one round, but by transporting it around the transport unit 16 for a plurality of rounds.

For example, when the operator inserts a banknote or a test banknote into the inlet 11 at the time of the maintenance checks, the banknote handling apparatus 1 circulates the inserted banknote or a test banknote on the transport unit 16 for a plurality of rounds. The banknote handling apparatus 1 also uses the transport-error detecting sensors 17 arranged at different positions of the transport unit 16 to measure the meandering or skewing, a time required for each round, and the like.

Thereafter, the banknote handling apparatus 1 calculates an average or the like of a measurement result obtained for each round, identifies a malfunction or the like of the transport unit 16 based on the calculated average or the like, and displays the identified malfunction as alert information onto the display unit 20 or the like. For example, wear-out and breakage of the belt and pulleys, presence of a foreign object, breakage of a banknote guide, and the like are displayed as the alert information on the display unit 20 or the like of the banknote handling apparatus 1.

In this manner, when a malfunction or the like of the transport unit 16 is identified by transporting a banknote or a test banknote, the banknote or the test banknote is circulated for a plurality of rounds to obtain statistical information. Accordingly, the malfunction or the like of the transport unit 16 can be identified further accurately.

The banknote handling apparatus 1 can store test banknotes in an unused stacker and feed one test banknote from this stacker at regular intervals to perform maintenance check processes. In this manner, the maintenance check processes can take place without operator intervention.

Generally, a banknote recognition unit, such as the recognizing and counting unit 12, is manufactured separately from the banknote handling apparatus to foster versatility. The banknote recognition unit generates, for example, a recognition machine code that includes "country", "version", and "denomination" such as "US, version 0, $10", as the banknote recognition result, and outputs the generated recognition machine code to the controlling unit of the banknote handling apparatus. Usually, the recognition machine code inputted from the banknote recognition unit is used as it is on the banknote handling apparatus side to implement various processes such as the deposit process.

In the banknote handling apparatus 1, however, there is a restriction on the processing time. If a code that contains a large amount of information, such as the recognition machine code, is to be dealt with, the process may not be completed within a predetermined period of time.

In view of the above, according to the present embodiment, the recognizing and counting unit 12 can use some other code that is simpler and has a smaller amount of data than the recognition machine code to output to the control unit 22. This aspect is explained below with reference to FIGS. 10A to 10C. FIGS. 10A to 10C are diagrams for explaining the depositing/dispensing process performed based on a processing machine code.

An overview of the depositing/dispensing process based on a processing machine code is shown in FIG. 10A, an example of a correspondence table of processing machine codes and recognition machine codes is shown in FIG. 10B, and an operation example of a depositing process based on the processing machine code is shown in FIG. 10C.

As shown in FIG. 10A, after performing the banknote recognition process, the recognizing and counting unit 12 outputs the recognition result, not in the form of a recognition machine code but in the form of a processing machine code, to the control unit 22 of the banknote handling apparatus 1 (see (A-1) of FIG. 10A). Based on the processing machine code inputted from the recognizing and counting unit 12, the control unit 22 performs the depositing process. If a dispensing instruction is received in the form of a processing machine code from the upper terminal 2 or the like, the control unit 22 performs the dispensing process based on the processing machine code (see (A-2) of FIG. 10A).

The banknote handling apparatus 1 stores therein the correspondence table that indicates a correspondence relation between the processing machine codes and the recognition machine codes. As shown in FIG. 10B, for example, in the correspondence table, a recognition machine code "US, version 0, $1" corresponds to a processing machine code "1", and a recognition machine code "US, version 0, $5" corresponds to a processing machine code "2". The correspondence table is created, for example, by using the upper terminal 2, and downloaded to the banknote handling apparatus 1.

The recognizing and counting unit 12 differentiates and recognizes the banknotes that have the same country and denomination but different version, such as the banknotes with the recognition machine code "US, version 0, $1" and the banknotes with the recognition machine code "US, version 1, $1". In such a situation, different processing machine codes are assigned to the banknotes having the same denomination but different version (e.g., a new printed version 1-dollar banknote and an old printed version 1-dollar banknote). In other words, the banknote handling apparatus 1 differentiates new version and old version banknotes to perform the processes.

For example, as shown in FIG. 10C, when the recognizing and counting unit 12 recognizes the banknote with the recognition machine code "US, version 0, $1", the processing machine code "1" is outputted from the recognizing and counting unit 12 to the control unit 22, and the control unit 22 stores this banknote into a stacker A corresponding to the processing machine code "1" (see (C-1) of FIG. 10C). On the other hand, when the recognizing and counting unit 12 recognizes the banknote with the recognition machine code "US, version 1, $1", the processing machine code "7" is outputted from the recognizing and counting unit 12 to the control unit 22, and the control unit 22 stores this banknote into a stacker B corresponding to the machine code "7" (see (C-2) of FIG. 10C).

In this manner, the recognizing and counting unit 12 outputs the recognition result to the control unit 22 in a processing machine code that has a smaller data volume than that of the recognition machine code, and the control unit 22 performs a depositing/dispensing process using the processing machine code. This reduces the volume of data processed inside the banknote handling apparatus 1 and the volume of data exchanged between the banknote handling apparatus 1 and the upper terminal 2, thereby increasing the processing speed. Hence, even if there is a strict restriction on the processing time, the process can be completed within a predetermined period of time.

Moreover, the issuance of new version banknotes, a change of the recognizing and counting unit 12, and the like can be readily dealt with, simply by changing the correspondence table.

If banknotes of an old version (here, banknotes of version 0) are to be collected so that they would not be used for dispensing, as shown in FIG. 10C, the stacker A for storing the banknotes of the old version should be used only for the deposit process.

Figures 11A, 11B:
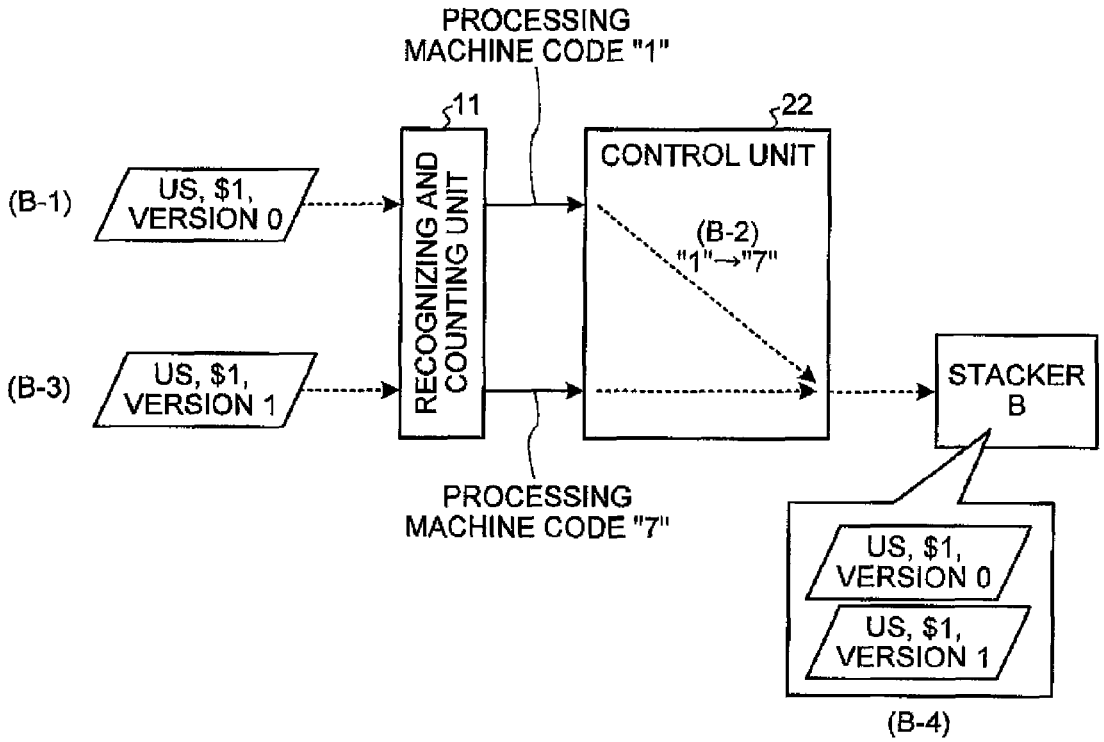
FIGS. 11A and 11B are diagrams for explaining a process performed without distinguishing whether banknotes are new or old.

In FIG. 10C, a case in which new version banknotes and old version banknotes are sorted and processed separately is explained. However, because those banknotes have the same values, the new version banknotes and old banknotes can be processed without being distinguished from each other. This aspect is explained below with reference FIGS. 11A and 11B. FIGS. 11A and 11B are diagrams for explaining the process performed without distinguishing the new and old banknotes from each other. In FIG. 11A, an example of a replacement table used for replacing a processing machine code of an old version banknote to a processing machine code of a new version banknote is shown, while in FIG. 11B, an operation example of a deposit process based on the replaced processing machine code is shown.

As shown in FIG. 11A, the banknote handling apparatus 1 stores therein the replacement table. This replacement table presents information that associates processing machine codes of the old version banknotes (pre-replacement processing machine codes) with processing machine codes of the new version banknotes (post-replacement processing machine codes). For example, in the replacement table, the processing machine code "1" of an old version banknote corresponds to the processing machine code "7" of a new version banknote.

The replacement table shown in FIG. 11A is created by the upper terminal 2, and downloaded to the banknote handling apparatus 1, in a similar manner to the correspondence table shown in FIG. 10B. In this manner, the correspondence table and the replacement table are shared between the banknote handling apparatus 1 and the upper terminal 2. This makes it easy to convert information when the banknote handling apparatus 1 sends the upper terminal 2 the deposit result and when the upper terminal 2 issues a dispensing instruction to the banknote handling apparatus 1. Furthermore, determination of validity of the deposit result and the dispensing instruction can be readily performed.

As shown in FIG. 11B, in the banknote handling apparatus 1, when the recognizing and counting unit 12 recognizes an old version banknote with the recognition machine code "US, version 0, $1" (see (B-1) of FIG. 11B), a processing machine code "1" is output from the recognizing and counting unit 12 to the control unit 22. Subsequently, the control unit 22 replaces the processing machine code "1" with the processing machine code "7" in accordance with the replacement table (see (B-2) of FIG. 11B). Then, the control unit 22 stores the old banknote with the recognition machine code "US, version 0, $1" into the stacker B that corresponds to the post-replacement processing machine code "7" (see (B-3) of FIG. 11B).

Moreover, in the banknote handling apparatus, when the received banknote is a new version banknote with the recognition machine code "US, version 1, $1", this new banknote is stored into the stacker B that corresponds to the processing machine code "7", in the same manner as shown in FIG. 10C. As a result, both new version banknotes and old version banknotes are stored in the stacker B without being separated from each other (see (B-4) of FIG. 11B).

Second Embodiment

According to the first embodiment, the banknote handling process can be efficiently performed by sorting and processing rejected banknotes in accordance with the reject reason or the like. However, when only the recognizing and counting processes are to be performed or the banknotes are to be placed in the same face/back orientation, without storing the banknotes, the processing efficiency would be lowered if a small, desktop-size banknote handling apparatus that does not include a storing unit is required separately from the banknote handling apparatus that includes the storing unit according to the first embodiment. As a second embodiment, to further increase the efficiency of the banknote handling process, a method of completing all the banknote handling processes including the recognizing and counting process and the reversing process without performing the storing process, using only a banknote handling apparatus that includes a storing unit, is explained.

Figure 12A:
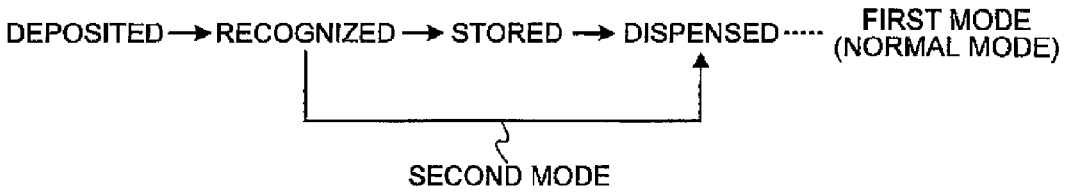
FIGS. 12A and 12B are diagrams showing an outline of a banknote handling technique according to a second embodiment.
Figure 12B:
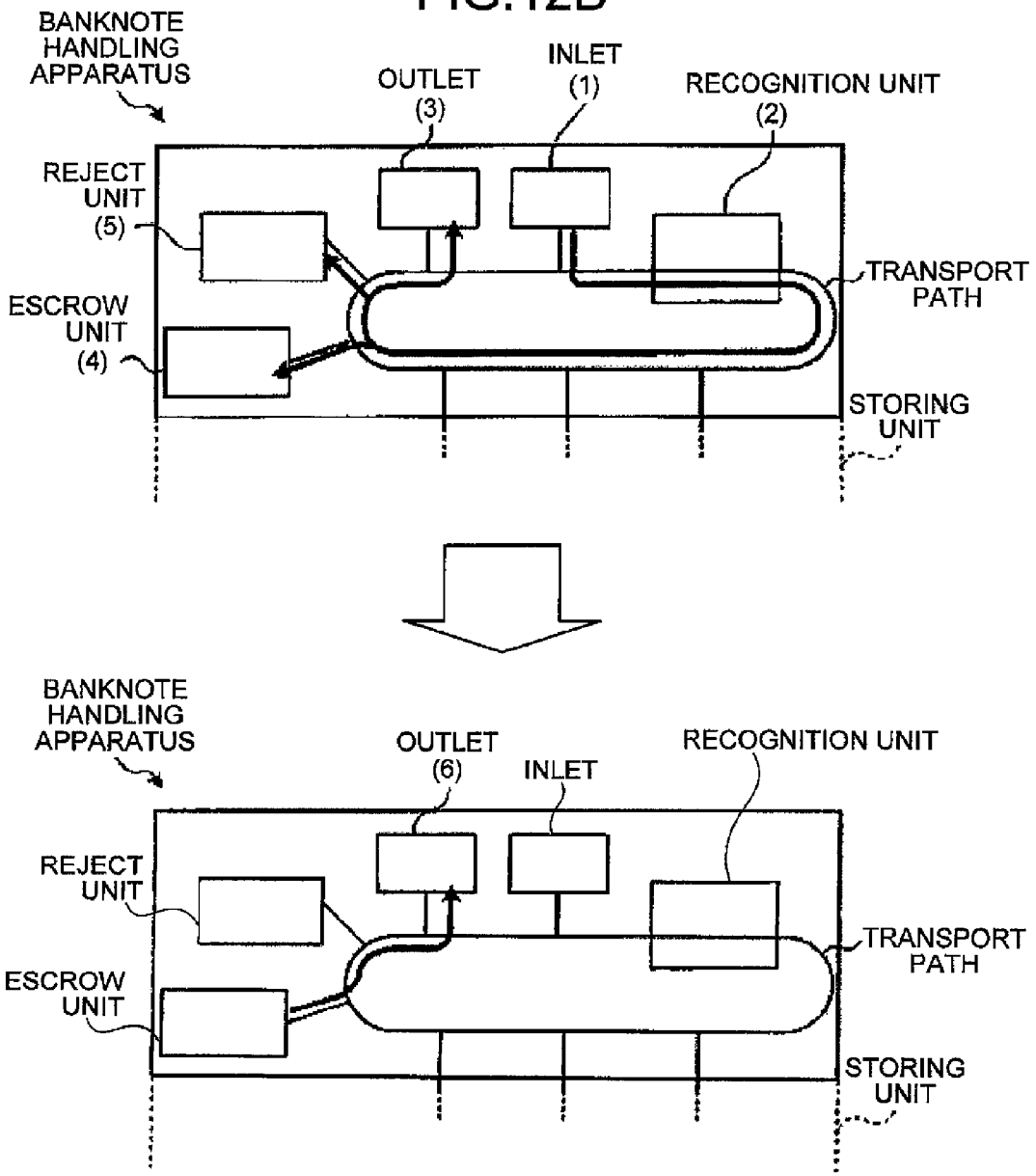

First, before explaining the second embodiment in detail, an overview of a banknote handling technique according to the present embodiment is explained with reference to FIGS. 12A and 12B. FIGS. 12A and 12B are diagrams showing an overview of the banknote handling technique according to the present embodiment. In FIG. 12A, two operation modes adopted in the banknote handling technique according to the present invention are shown, while in FIG. 12B, an operation example when the operation mode is the second mode is shown.

As shown in FIGS. 12A and 12B, with the banknote handling technique according to the present invention, deposited banknotes, without being stored in the storing unit, are subjected to recognition and counting, and then dispensed. Furthermore, with the banknote handling technique according to the present invention, by using the escrow unit that can escrow fed-in banknotes and feed them back, the deposited banknotes can be sorted and dispensed in accordance with their denomination, or the banknotes can be dispensed with a uniform face/back orientation.

More specifically, as shown in FIG. 12A, the banknote handling technique according to the present invention includes a first mode in which banknotes are processed with the same process procedure as the conventional banknote handling apparatus, and the second mode that is a featuring operation mode of the present invention.

More specifically, in the first mode, when the "deposit" of banknotes is received, the deposited banknotes are "recognized", the recognized banknotes are "stored" in accordance with their denomination based on the recognition result, and the stored banknotes are "dispensed" in response to the user's operation or the like. On the other hand, in the second mode, after the deposited banknotes are "recognized", the recognized banknotes are "dispensed" without being stored.

The operation of the banknote handling apparatus in the second mode is explained in detail with reference to FIG. 12B. As shown in FIG. 12B, in the banknote handling apparatus, upon receiving the deposit of banknotes (see (1) of FIG. 12B), the recognition unit recognizes the banknotes transported along the transport path from the inlet (see (2) of FIG. 12B). The recognition unit recognizes denomination, authenticity, fitness, face/back orientation, portrait-upright/portrait-inverted, and the like of the banknotes. Moreover, the recognition unit also performs a process of counting the recognized banknotes for each denomination.

Thereafter, in accordance with the recognition result obtained by the recognition unit, the banknote handling apparatus discharges banknotes of a first kind to the outlet (see (3) of FIG. 12B), escrows banknotes of a second kind in the escrow unit (see (4) of FIG. 12B), and discharges other banknotes to the reject unit (see (5) of FIG. 12B). Then, the banknote handling apparatus discharges the banknotes escrowed in the escrow unit to the outlet at a predetermined timing (see (6) of FIG. 12B).

The banknotes of the first kind and the banknotes of the second kind can be determined by the user, as desired. For example, if the banknotes of the first kind are determined as 10000-yen banknotes, and the banknotes of the second kind are determined as 1000-yen banknotes, even if a plurality of banknotes including 5000-yen banknotes and counterfeit or unfit banknotes are inserted altogether into the inlet, only 10000-yen banknotes and 1000-yen banknotes can be recognized and counted from these banknotes, and discharged to the outlet.

Furthermore, by escrowing the 1000-yen banknotes in the escrow unit and discharging all the 10000-yen banknotes to the outlet and then discharging the 1000-yen banknotes to the outlet from the escrow unit, the 10000-yen banknotes and the 1000-yen banknotes can be discharged separately.

Moreover, the escrow unit changes the face/back orientation of the banknotes that are fed in from the transport path and feeds them back to the transport path. For this reason, if the banknotes of the first kind are determined as "face-up banknotes" of the 10000-yen banknotes and the banknotes of the second kind are determined as "face-down banknotes" of the 10000-yen banknotes, these 10000-yen banknotes can still be recognized and counted even when a plurality of 10000-yen banknotes are inserted into the inlet with their face/back orientations randomly arranged, and furthermore, they can be discharged through the outlet with their face/back orientations uniformly arranged. The banknote face/back reversing process performed by the escrow unit has been explained with reference to FIG. 3 according to the first embodiment, and therefore the detailed explanation thereof is omitted here.

As discussed above, the banknote handling technique according to the present invention includes the first mode in which the banknotes recognized by the recognition unit are stored in the storing unit, and the second mode in which the banknotes recognized by the recognition unit are discharged without being stored in the storing unit. When the operation mode is the second mode, the banknotes recognized by the recognition unit are sent to either one of the outlet, the reject unit, and the escrow unit, based on the recognition result, and therefore the deposited banknotes can be recognized and counted without being stored in the storing unit.

Moreover, with the banknote handling technique according to the present invention, the banknotes of the second kind are escrowed by the escrow unit and then discharged to the outlet. Accordingly, while the banknotes, which are not the recognition and counting target banknotes, are discharged to the reject unit, banknotes of two different denominations can be recognized and counted, and these banknotes of the two different denominations can also be sorted and discharged in accordance with the denominations.

A situation in which the banknotes escrowed by the escrow unit are discharged to the outlet is explained; however, the configuration is not limited to discharging the banknotes to the outlet. The banknotes can also be discharged to the inlet or the reject unit. The process of discharging the banknotes escrowed by the escrow unit to the inlet or the reject unit can be started in accordance with a manual operation such as a button operation, or started automatically upon detecting that there is no banknote in the inlet or the reject unit.

Before starting discharging of the banknotes from the escrow unit to the inlet or the reject unit, information indicating that the discharged banknotes are the processing target banknotes that are already recognized is displayed on a predetermined display unit.

The banknote handling apparatus and the banknote handling method adopting the banknote handling technique explained with reference to FIGS. 12A and 12B are explained below in detail. The second embodiment is explained using the apparatus 1 according to the first embodiment shown in FIG. 2. The functions and operations of the apparatus 1 that have been explained in the first embodiment are omitted from the detailed explanation here. Similarly, the functions and operations of the units included in the apparatus 1 have already been explained in the first embodiment, and therefore the detailed explanation thereof is omitted. The functions and operations of the apparatus 1 according to the second embodiment that are different from the first embodiment are explained below in detail.

First, the operation in the first mode (normal mode) is explained with reference to FIG. 2. When the operation mode is the first mode, the banknote handling apparatus 1 transports the banknotes received at the inlet 11 to the recognizing and counting unit 12 via the transport path 16, and stores banknotes into the corresponding stackers 21*a* to 21*e* based on the recognition result of the banknotes obtained by the recognizing and counting unit 12.

More specifically, the banknote handling apparatus 1 stores the banknotes recognized as 1000-yen banknotes by the recognizing and counting unit 12 into the stacker 21*a* via the transport path 16, the banknotes recognized as 2000-yen banknotes into the stacker 21*b*. Similarly, the banknote handling apparatus 1 stores the banknotes recognized as 5000-yen banknotes by the recognizing and counting unit 12 into the stacker 21*c* via the transport path 16, and the banknotes recognized as 10000-yen banknotes into the stacker 21*d* via the transport path 16.

The banknote handling apparatus 1 also discharges rejected banknotes (rejected notes) that are judged by the recognizing and counting unit 12 as counterfeit banknotes, unfit banknotes, or unrecognizable banknotes to the reject unit 14. In this manner, while the rejected banknotes are discharged, other normal banknotes are stored in accordance with their denomination, based on the recognition result of the banknotes obtained by the recognizing and counting unit 12.

Moreover, upon receiving a dispensing operation from the user, the banknote handling apparatus 1 feeds banknotes corresponding to the operation from the stackers 21*a* to 21*d*, transports them by the transport path 16, and discharges them to the outlet 13. In the banknote handling apparatus 1, the recognizing and counting unit 12 recognizes the banknotes fed from the stackers 21*a* to 21*d* again, and stacks improper banknotes, if any, in the stacking unit 22.

A case is explained in which the banknotes received at the inlet 11 are stored into the stackers 21*a* to 21*e* without using the escrow unit 15; however, the escrow unit 15 can be used at the time of depositing. For example, after escrowing the deposited banknotes except for the rejected banknotes in the escrow unit 15, the banknote handling apparatus 1 displays the counting result onto a display unit 114 that is described later. Then, the banknote handling apparatus 1 can store the deposited banknotes escrowed in the escrow unit 15 into the stackers 21*a* to 21*e*, after the counting result is approved in the user's operation.

Figure 13:
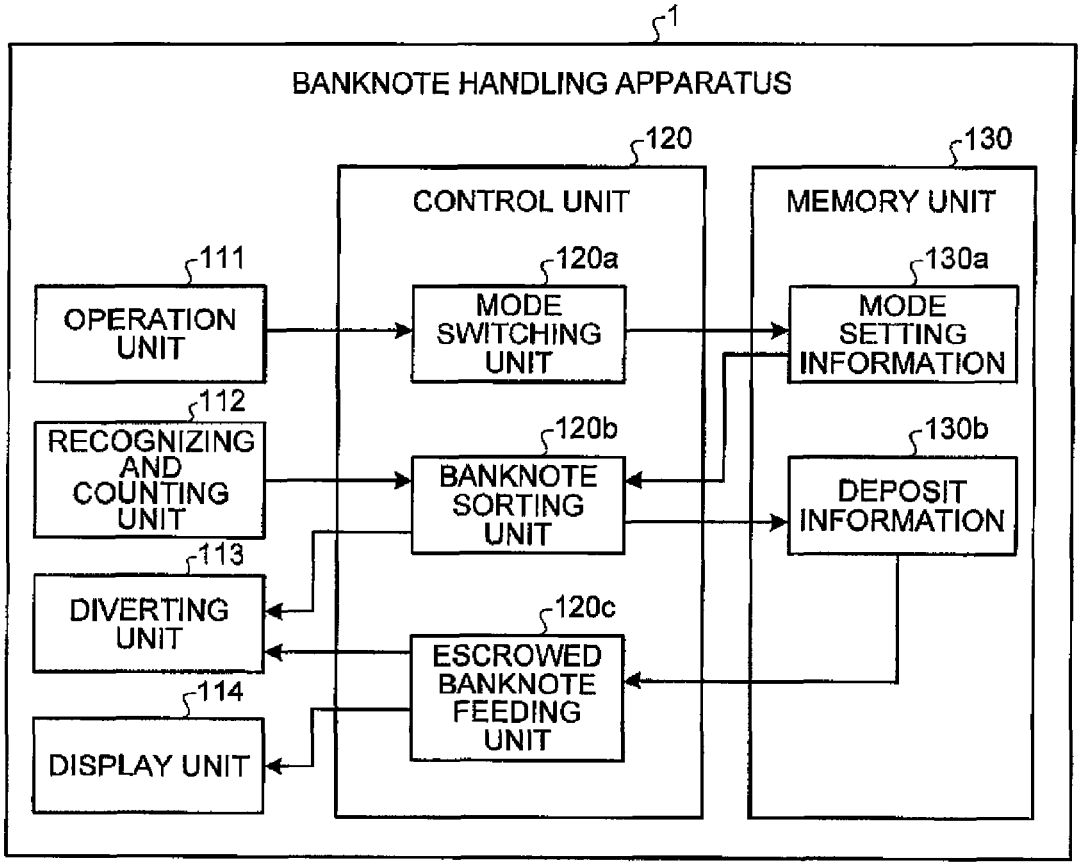
FIG. 13 is a block diagram showing a functional structure of a banknote handling apparatus according to the second embodiment.

Next, a functional structure of the banknote handling apparatus 1 according to the present embodiment is explained with reference to FIG. 13. FIG. 13 is a block diagram of the functional structure of the banknote handling apparatus according to the present embodiment. In FIG. 13, only the structural elements necessary for explaining the features of the banknote handling apparatus 1 are shown, and general structural elements are omitted from the description.

As shown in FIG. 13, the banknote handling apparatus 1 according to the present embodiment includes an operation unit 111, a recognizing and counting unit 122, a diverting unit 113, a display unit 114, a control unit 120, and a memory unit 130. The control unit 120 includes a mode switching unit 120*a*, a banknote sorting unit 120*b*, and an escrowed banknote feeding unit 120*c*. The memory unit 130 stores therein mode setting information 130*a* and deposit information 130*b*.

The operation unit 111 is an input device that receives various operations from the user. More specifically, the operation unit 111 receives operations such as an operation mode switching instruction and designation of target banknotes for recognition and counting. Upon receiving an operation mode switching instruction or designation of target banknotes for recognition and counting from the user, the operation unit 111 sends the mode switching unit 120*a* the switching instruction or target banknote designation information. A feeding-in start instruction for the banknotes inserted into the inlet 11 can be received by using the operation unit 111.

The recognizing and counting unit 122 corresponds to the recognizing and counting unit 12 shown in FIG. 2, and performs various kinds of recognition processes, such as recognition of denomination, authenticity, fitness, face/back orientation, and portrait-upright/portrait-inverted orientation on the banknotes transported by the transport path 16, and also performs a counting process on the recognized banknotes. Additionally, the recognizing and counting unit 122 sends the banknote sorting unit 120*b* a recognition result and a counting result of each recognizing and counting process of the banknotes that is executed.

The diverting unit 113 is a path diverter arranged at each branching point of the transport path 16. More specifically, the diverting unit 113 swings between a position at which the banknotes transported by the transport path 16 are directly transported downstream of the transport path 16 and a position at which the banknotes are transported to the structural components (e.g., the outlet 13 and the stackers 21*a* to 21*e*) connected to the transport path 16, so that the banknotes can be discharged to a desired location. For example, the diverting unit 113 is provided at the branching point of the transport path 16 and the switchback path 15*a*, the branching point of the transport path 16 and the outlet 13, and the branching point of the transport path 16 and the inlet 11.

The display unit 114 displays the recognition result and the counting result of the banknotes obtained by the recognizing and counting unit 122.

The control unit 120 is a processing unit for executing processes such as switching of the operation modes, sorting of the recognized banknotes, and feeding out of the banknotes escrowed in the escrow unit 15. The mode switching unit 120*a* is a processing unit that, upon receiving a mode switching instruction from the operation unit 111, updates the mode setting information 130*a* and thereby switches the operation modes between the first mode and the second mode. Moreover, the mode switching unit 120*a* stores the target banknote designation information received from the operation unit 111 also as the mode setting information 130*a* in the memory unit 130. That is, the mode setting information 130*a* includes information on the currently set operation mode and information on the designation information regarding the target banknotes.

The banknote sorting unit 120*b* is a processing unit that, upon receiving the recognition result of the banknotes from the recognizing and counting unit 122, swings the diverting unit 113 in accordance with the received recognition result and thereby sorts the banknotes into different units. More specifically, the banknote sorting unit 120*b* refers to the mode setting information 130*a*. When the operation mode is the first mode, the banknote sorting unit 120*b* sorts the banknotes recognized as being proper by the recognizing and counting unit 122 into the stackers 21*a* to 21*e* according to their denominations. The banknote sorting unit 120*b* also sorts the banknotes recognized as being improper by the recognizing and counting unit 122 to the reject unit 14.

On the other hand, when the operation mode is the second mode, the banknote sorting unit 120*b* sorts the banknotes into the outlet 13, the reject unit 14, and the escrow unit 15, in accordance with the recognition result obtained by the recognizing and counting unit 122. An operation example of the banknote sorting unit 120*b* in the second mode will be described later with reference to FIGS. 14A and 14B and FIGS. 15A to 15D.

Moreover, the banknote sorting unit 120*b* updates the deposit information 130*b* in accordance with the recognition result and the counting result received from the recognizing and counting unit 122. The deposit information 130*b* includes history information of the recognition result of the banknotes and the counting result of each denomination.

The escrowed banknote feeding unit 120*c* is a processing unit that, when the operation mode is the second mode and banknotes are sent to the escrow unit 15 by the banknote sorting unit 120*b*, feeds out the banknotes from the escrow unit 15 to the outlet 13. The escrowed banknote feeding unit 120*c* also executes a process of displaying the counting result of the banknotes onto the display unit 114 by referring to the deposit information 130*b*.

Figure 14A:
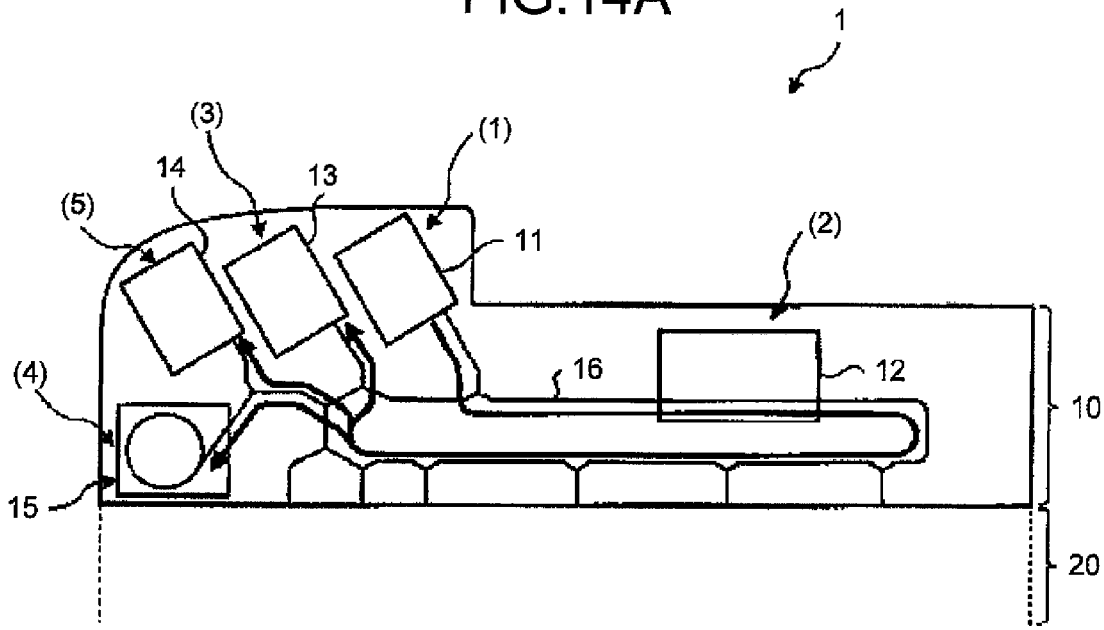
FIGS. 14A and 14B are diagrams showing an operation example of a banknote sorting unit and an escrowed banknote feeding unit according to the second embodiment.
Figure 14B:
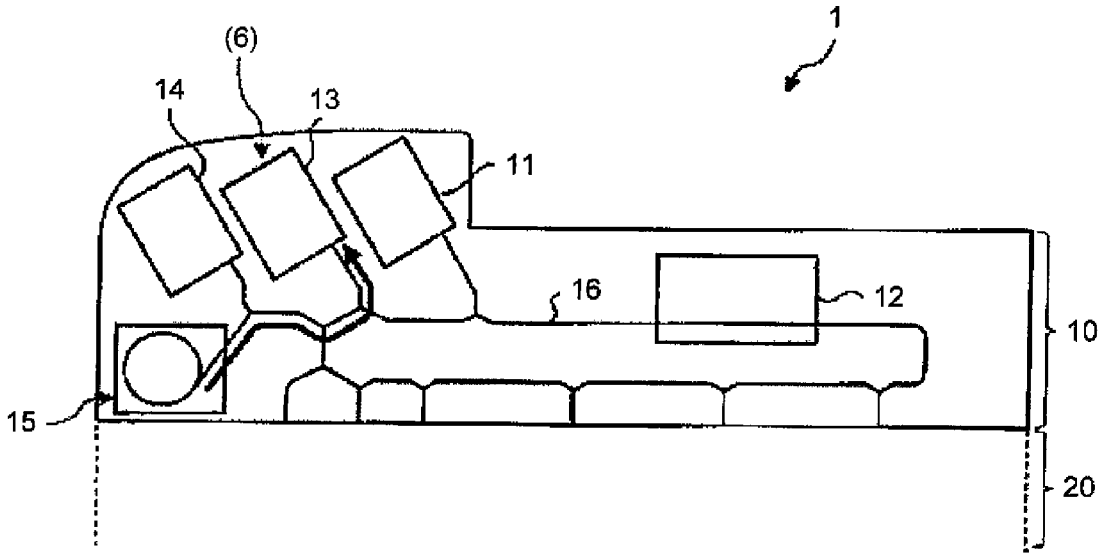

Operation examples of the banknote sorting unit 120*b* and the escrowed banknote feeding unit 120*c* are explained with reference to FIGS. 14A and 14B. FIGS. 14A and 14B are diagrams showing operation examples of the banknote sorting unit 120*b* and the escrowed banknote feeding unit 120*c* according to the present embodiment.

In this example shown in FIGS. 14A and 14B, it is assumed that the recognition and counting target banknotes are 10000-yen banknotes and that the 10000-yen banknotes subjected to recognition and counting process are discharged with the same face/back orientation. An operation example of the banknote sorting unit 120*b* is shown in FIG. 14A, and an operation example of the escrowed banknote feeding unit 120*c* is shown in FIG. 14B.

As shown in FIG. 14A, 10000-yen banknotes including banknotes to be rejected (counterfeit banknotes and unrecognizable banknotes) are inserted into the inlet 11 with their face/back orientations randomly arranged (see (1) of FIG. 14A). In such a situation, in the banknote handling apparatus 1, the recognizing and counting unit 12 recognizes and counts the banknotes that are inserted into the inlet 11, one by one (see (2) of FIG. 14A). Thereafter, the banknote sorting unit 120*b* sends the recognized and counted banknotes to one of the outlet 13, the reject unit 14, and the escrow unit 15 in accordance with the recognition result.

More specifically, when the banknotes transported to the recognizing and counting unit 12 are recognized as 10000-yen banknotes that are placed face-up, the banknote sorting unit 120*b* swings the diverting unit 113 arranged between the transport path 16 and the outlet 13, and discharges these banknotes to the outlet 13 (see (3) of FIG. 14A).

When the banknotes transported to the recognizing and counting unit 12 are recognized as 10000-yen banknotes that are placed face-down, the banknote sorting unit 120*b* swings the diverting unit 113 arranged between the transport path 16 and the escrow unit 15 (switchback path 15*a*) and escrows these banknotes in the escrow unit 15 (tape-type winding unit 15*b*) (see (4) of FIG. 14A). The banknote sorting unit 120*b* also discharges the banknotes that are recognized as rejected banknotes by the recognizing and counting unit 12 to the reject unit 14 (see (5) of FIG. 14A).

When a remaining banknote detecting sensor arranged in the inlet 11 no longer detects any banknotes remaining in the inlet 11 and the banknote sorting unit 120*b* finishes sorting all the banknotes inserted into the inlet 11, the escrowed banknote feeding unit 120*c* discharges the face-down 10000-yen banknotes escrowed by the escrow unit 15 to the outlet 13, as shown in (B) of FIG. 14B.

More specifically, the escrowed banknote feeding unit 120*c* swings the diverting unit 113 between the transport path 16 and the switchback path 15*a*, and then feeds the face-down 10000-yen banknotes escrowed by the escrow unit 15 out to the transport path 16. As described above, the face-down 10000-yen banknotes escrowed by the escrow unit 15 are fed out to the transport path 16 with their face/back orientation reversed. Then, the escrowed banknote feeding unit 120*c* swings the diverting unit 113 between the transport path 16 and the outlet 13 to discharge the banknotes fed from the escrow unit 15 to the transport path 16, to the outlet 13 (see (6) of FIG. 14B). In this manner, only the face-up 10000-yen banknotes are stacked in the outlet 13.

As described above, the banknote sorting unit 120*b* sends, among the banknotes recognized by the recognizing and counting unit 12 as of a predetermined denomination, face-up banknotes to the outlet 13 and face-down banknotes to the escrow unit 15. The escrowed banknote feeding unit 120*c* reverses the face/back orientation of the banknotes that are sent to the escrow unit 15 before feeding them out to the outlet 13. Thus, even if the banknotes are inserted with random face/back orientations, banknotes of the predetermined denomination among these banknotes can be recognized and counted, and the banknotes of the predetermined denomination can be discharged with the uniform face/back orientation.

In other words, the banknote handling apparatus 1 according to the present embodiment does not require a dedicated apparatus for performing only the recognition and counting process. Therefore, extra installation space for such a dedicated apparatus is not required, and the installation costs can be reduced. Furthermore, despite a lack of a dedicated face/back reversing mechanism separately installed in the apparatus, the recognizing and counting process and the face/back reversing process can be executed simultaneously.

A user can determine a kind of banknotes assigned to each of the outlet 13, the reject unit 14, and the escrow unit 15, as desired, by using the operation unit 111. Other operation examples of the banknote sorting unit 120*b* and the escrowed banknote feeding unit 120*c* are explained below with reference to FIGS. 15A to 15D. FIGS. 15A to 15D are diagrams showing other operation examples of the banknote sorting unit 120*b* and the escrowed banknote feeding unit 120*c*.

In FIG. 15A, an operation example of the banknote sorting unit 120*b* and the escrowed banknote feeding unit 120*c* when 10000-yen banknotes and 1000-yen banknotes are determined as the target banknotes is shown. As shown in FIG. 15A, a plurality of banknotes including 10000-yen banknotes, 5000-yen banknotes, 1000-yen banknotes, and rejected banknotes are inserted into the inlet 11 (Step 1). In such a situation, the banknote sorting unit 120*b* sends the banknotes recognized as the 10000-yen banknotes to the outlet 13, the banknotes recognized as 1000-yen banknotes to the escrow unit 15, and other banknotes (the 5000-yen banknotes and the rejected banknotes) to the reject unit 14 (Step 2).

When a remaining banknote detecting sensor arranged in the outlet 13 no longer detects any banknotes remaining in the outlet 13, or in other words, when the user picks up the 10000-yen banknotes discharged to the outlet 13, the escrowed banknote feeding unit 120*c* feeds the 1000-yen banknotes escrowed in the escrow unit 15 to the outlet 13 (Step 3).

In this manner, the banknote sorting unit 120*b* sends the banknotes recognized as a first denomination by the recognizing and counting unit 12 to the outlet 13 and the banknotes recognized as a second denomination to the escrow unit 15, and the escrowed banknote feeding unit 120*c* feeds out the banknotes of the second denomination that are sent to the escrow unit 15, to the outlet 13. Then, banknotes of two kinds can be recognized and counted from among the plurality kinds of banknotes inserted into the inlet 11, and the banknotes of these two kinds can be sorted in accordance with their denominations and discharged separately.

In addition, the banknote sorting unit 120*b* sends the rejected banknotes such as counterfeit banknotes and unrecognizable banknotes and banknotes other than the banknotes recognized as of the predetermined denomination (such as 5000-yen banknotes) to the reject unit 14, while the escrowed banknote feeding unit 120*c* feeds out the banknotes sent to the escrow unit 15 by the banknote sorting unit 120*b* to one of the outlet 13, the inlet 11, and the reject unit 14. Therefore, even when the banknotes that are not the recognition and counting targets are included, the target banknotes can be recognized and counted, while the non-target banknotes are stacked separately into the reject unit 14.

Furthermore, when the remaining banknote detecting sensor detects no banknote remaining in the outlet 13, the escrowed banknote feeding unit 120*c* feeds out the banknotes of the second denomination sent to the escrow unit 15, to the outlet 13. In other words, the escrowed banknote feeding unit 120*c* feeds the banknotes that are sent to the escrow unit 15 by the banknote sorting unit 120*b*, to the reject unit 14 or the outlet 13 which is detected by the remaining banknote detecting sensor as having no remaining banknote. Hence, the user can separately pick up the banknotes of the first denomination and the banknotes of the second denomination.

As shown in FIG. 15A, the banknotes of the second denomination are discharged to the outlet 13 after the user picks up the banknotes of the first denomination from the outlet 13. However, the banknotes of the second denomination can be discharged to the outlet 13 immediately after the banknotes of the first denomination are discharged to the outlet 13. Moreover, after the banknotes of the first denomination are discharged to the outlet 13, the completion of discharging of the first-denomination banknotes can be displayed onto the display unit 114, and the banknotes of the second denomination can be discharged to the outlet 13 when the user issues an instruction to discharge the banknotes of the second denomination by using the operation unit 111.

The banknotes escrowed in the escrow unit 15 can be discharged, not to the outlet 13, but to the inlet 11. In such a situation, the banknotes of the first denomination and the second denomination can be discharged from the outlet 13 and the inlet 11 at the same time. A discharging destination and a discharging timing of the banknotes escrowed by the escrow unit 15 can be determined by the user, as desired.

Moreover, each of the processing target 10000-yen banknotes and 1000-yen banknotes can be discharged to either one of the outlet 13 and the reject unit 14, and the rejected banknotes can be escrowed in the escrow unit 15. In such a situation, immediately after the processing of all the processing target banknotes is finished, the processing target banknotes subjected to the recognition and counting are discharged to the outlet 13 and the reject unit 14. In other words, each of the banknotes of the first denomination and the second denomination are discharged separately from the banknotes of other denominations, and therefore the banknotes of the first denomination and the second denomination can be immediately sent to the next processing.

The rejected banknotes escrowed in the escrow unit 15 can be discharged to the inlet 11, or can be discharged to either one of the outlet 13 and the reject unit 14 after the processing target banknotes are picked up. The discharging destination of the processing target banknotes can also be determined by the user, as desired.

Moreover, any necessary information, for example, regarding the banknotes discharged to the inlet 11, the outlet 13, and the reject unit 14 and regarding the banknotes escrowed in the escrow unit 15 is displayed on the display unit 114 at the time of processing, and therefore the user can perform processes without being confused.

Moreover, when only the recognition and counting target banknotes are inserted to the inlet 11, the banknotes of the first denomination can be discharged to the outlet 13 and the banknotes of the second denomination can be discharged to the reject unit 14. For example, as shown in FIG. 15B, only 10000-yen banknotes and 1000-yen banknotes are inserted into the inlet 11 (Step 1). In such a situation, the banknote sorting unit 120*b* sends the banknotes recognized as 10000-yen banknotes to the outlet 13, and the banknotes recognized as 1000-yen banknotes not to the escrow unit 15, but to the reject unit 14 (Step 2). In this manner, the user can pick up the banknotes of the two denominations, which are the recognition and counting targets, at the same time.

The banknotes of the two denominations are recognized and counted, and the recognized and counted banknotes of the two denominations can be discharged with the uniform face/back orientation. More specifically, as shown in FIG. 15C, banknotes only including 10000-yen banknotes and 1000-yen banknotes are inserted into the inlet 11 (Step 1). Then, the banknote sorting unit 120*b* sends banknotes recognized as face-up 10000-yen banknotes to the outlet 13, banknotes recognized as face-up 1000-yen banknotes to the reject unit 14, and banknotes recognized as face-down 10000-yen banknotes and banknotes recognized as face-down 1000-yen banknotes to the escrow unit 15 (Step 2).

After finishing sorting all the banknotes to the units, the escrowed banknote feeding unit 120*c* discharges, among the banknotes escrowed by the escrow unit 15, the face-down 10000-yen banknotes to the outlet 13, and the face-down 1000-yen banknotes to the reject unit 14 (Step 3). The face-down 10000-yen banknotes and the face-down 1000-yen banknotes that are fed from the escrow unit 15 are discharged to the outlet 13 and the reject unit 14 with the face/back orientation reversed, as described above. Thus, only the face-up 10000-yen banknotes are stacked in the outlet 13, and the face-up 1000-yen banknotes are stacked in the reject unit 14.

In this manner, the banknotes of the two denominations can be simultaneously recognized and counted, and the recognized and counted banknotes of two denominations can be discharged with the uniform face/back orientation. The escrowed banknote feeding unit 120*c* can identify the order of the face-down 10000-yen banknotes and the face-down 1000-yen banknotes escrowed in the escrow unit 15, by referring to the deposit information 130*b*. Thus, the escrowed banknote feeding unit 120*c* discharges the face-down 10000-yen banknotes to the outlet 13, and the face-down 1000-yen banknotes to the reject unit 14, from among the banknotes escrowed in the escrow unit 15, by referring to the deposit information 130*b*.

Moreover, in addition to the banknotes having the uniform face/back orientation, the banknotes can be discharged by distinguishing their portrait-upright/portrait-inverted orientations. More specifically, as shown in FIG. 15D, the 10000-yen banknotes are inserted into the inlet 11 (Step 1). Then, the banknote sorting unit 120*b* sends the banknotes recognized as portrait-upright face-up banknotes to the outlet 13, the banknotes recognized as portrait-inverted face-up banknotes to the reject unit 14, and the banknotes recognized as portrait-upright face-down banknotes and portrait-inverted face-down banknotes to the escrow unit 15 (Step 2).

When all the banknotes are sorted to each unit, the escrowed banknote feeding unit 120*c* discharges, from the escrow unit 15, the portrait-inverted face-down banknotes to the outlet 13, and the portrait-upright face-down banknotes to the reject unit 14 (Step 3). The portrait-upright face-down banknotes and the portrait-inverted face-down banknotes fed from the escrow unit 15 are discharged to the outlet 13 and the reject unit 14, respectively, with the face/back orientation reversed, as described above. With this configuration, only the portrait-upright face-up banknotes are stacked in the outlet 13, and only the portrait-inverted face-up banknotes are stacked in the reject unit 14. As a result, the user does not have to perform a cumbersome task of making the portrait-upright/portrait-inverted orientations of the recognized and counted banknotes all agreed.

Figure 16:
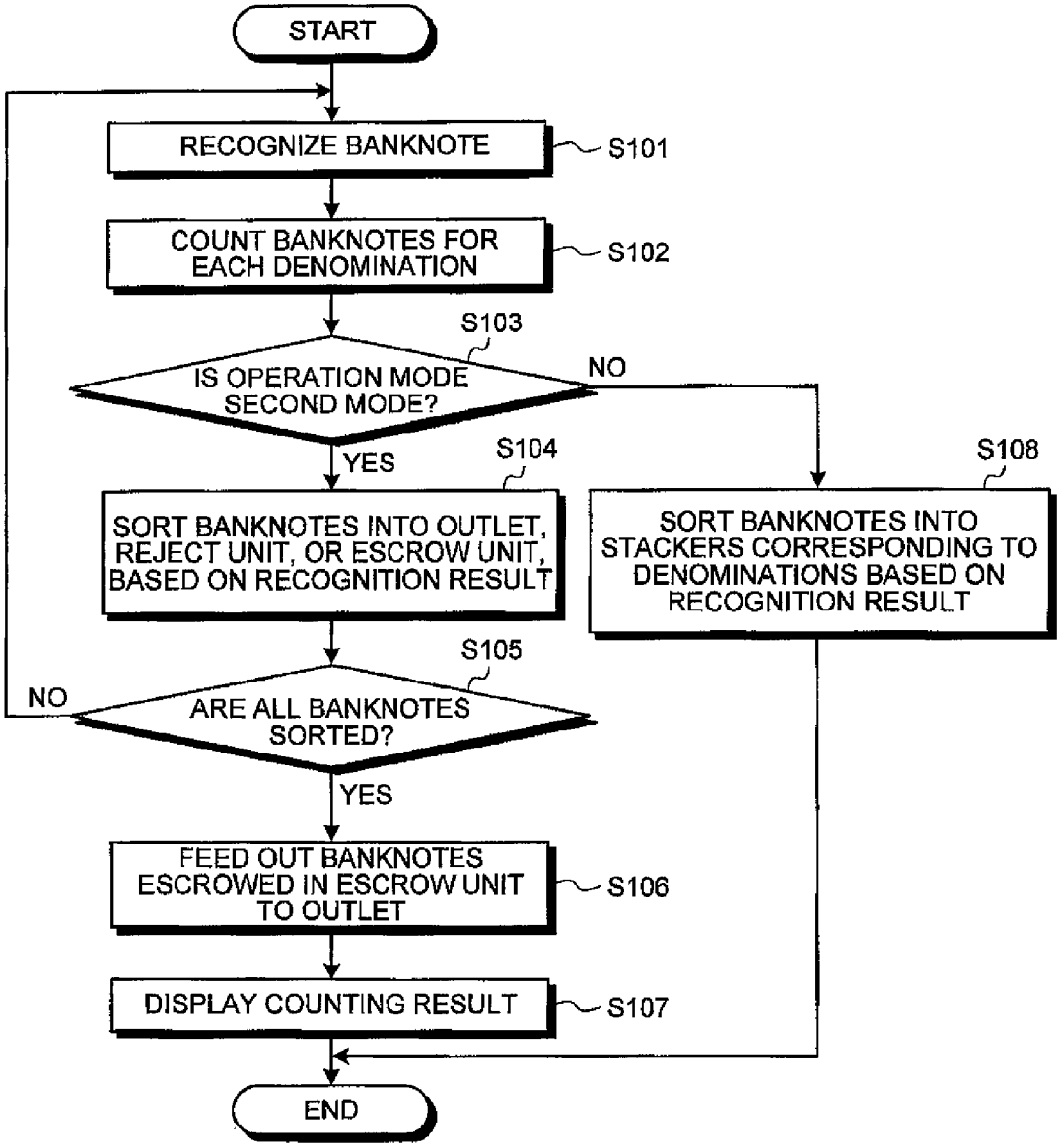
FIG. 16 is a flowchart of the process procedure performed by the banknote handling apparatus according to the second embodiment.

Next, the operation of the banknote handling apparatus 1 according to the present embodiment is explained more specifically, with reference to FIG. 16. FIG. 16 is a flowchart of the process procedure performed by the banknote handling apparatus 1.

As shown in FIG. 16, the recognizing and counting unit 122 recognizes the banknotes transported by the transport path 16 (Step S101), and counts them in accordance with their denomination (Step S102). Subsequently, the banknote sorting unit 120*b* determines whether the operation mode is the second mode, by referring to the mode setting information 130*a* (Step S103). Then, if the operation mode is the second mode (Yes at Step S103), the banknote sorting unit 120*b* sorts the banknotes into the outlet 13, the reject unit 14, or the escrow unit 15, based on the recognition result (Step S104).

Thereafter, the escrowed banknote feeding unit 120*c* determines whether all the banknotes are sorted into the units (Step S105). If the sorting of the banknotes is completed (Yes at Step S105), the escrowed banknote feeding unit 120*c* feeds out the banknotes escrowed in the escrow unit 15 to the outlet 13 (Step S106). Then, the escrowed banknote feeding unit 120*c* displays the counting result obtained by the recognizing and counting unit 122 onto the display unit 114 (Step S107), and terminates the processing.

If the operation mode is not the second mode at Step S103 (No at Step S103), or in other words, if the operation mode is the first mode, the banknote sorting unit 120*b* sorts the banknotes into the stackers 21*a* to 21*e* corresponding to their denominations in accordance with the recognition result (Step S108), and terminates the processing.

As described above, according to the present embodiment, the mode switching unit switches the operation mode between the first mode in which the banknotes recognized by the recognizing and counting unit are sorted into the stackers of the storing and feeding unit and the second mode in which the banknotes recognized by the recognizing and counting unit are discharged without being stored in the storing and feeding unit. When the operation mode is the second mode, the banknote sorting unit sorts the banknotes into the outlet, the reject unit, and the escrow unit in accordance with the recognition result obtained by the recognizing and counting unit. The escrowed banknote feeding unit discharges the banknotes that are sent to the escrow unit, to the outlet. Thus, the deposited banknotes can be recognized without being stored.

According to the present embodiment, the mode switching unit 120*a* switches the operation mode in response to the user's operation on the operation unit 111; however, the switching method of the operation mode is not limited thereto. For example, if the upper unit 10 and the lower unit 20 are separable, the operation mode can be switched in accordance with the connection state of the upper unit 10 and the lower unit 20.

In other words, when the upper unit 10 and the lower unit 20 are connected to each other, the operation mode is determined as the first mode, while when the upper unit 10 and the lower unit 20 are separated from each other, the operation mode is determined as the second mode. Hence, the burden on the user in switching of the operation mode can be reduced.

The operation mode is switched when the upper unit 10 and the lower unit 20 are physically separated; however the switching method is not limited thereto. For example, the operation mode can be switched when the upper unit 10 and the lower unit 20 are electromagnetically separated.

For example, the banknote handling apparatus 1 can include a lock function, which is for managing banknotes and avoiding trouble, to disable the storing of the banknotes into the lower unit 20 or discharging of the banknotes from the lower unit 20.

At this point, when the lock function is activated, the operation mode switching unit 120*a* can judge that the upper unit 10 and the lower unit 20 are electromagnetically disconnected even if they are physically connected to each other, and thereby switch the operation mode.

According to the present embodiment, the discharging of the banknotes that are escrowed by the escrow unit 15 to the outlet 13 is explained above; however, the discharging destination is not limited thereto. The banknotes can be discharged to the inlet 11.

In the explanation of the above embodiment, the escrow unit 15 is used as an example of the escrow unit that escrows the deposited banknotes and feeds them back to the transport path 16; however, the form of the escrow unit is not limited thereto. Any of the stackers 21*a* to 21*e* can be used as the escrow unit.

Still further, in the explanation of the second embodiment, the tape-type winding unit 15*b*, which is a so-called tape-type storing unit, is used to escrow the banknotes and feed them back to the transport path 16. However, any structure that can feed out the escrowed banknotes can be adopted, and, for example, a stacker-type storing unit similar to the stackers 21*a* to 21*e* can be used.

Third Embodiment

As explained in the second embodiment, a banknote handling apparatus including a banknote storing unit can be used, by providing it with a mode of recognition and counting banknotes without storing them, as an alternative to a desktop-size apparatus dedicated to the counting. However, when processing, a banknote handling apparatus including a storing unit consumes more power and generates more noise than a small banknote handling apparatus. According to the present embodiment, a banknote handling apparatus that can reduce power consumption and noise is explained.

Figure 17A:
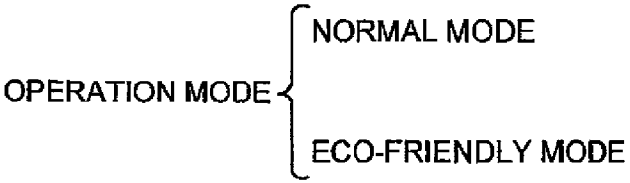
FIGS. 17A and 17B are diagrams showing an outline of a banknote handling technique according to a third embodiment.
Figure 17B:
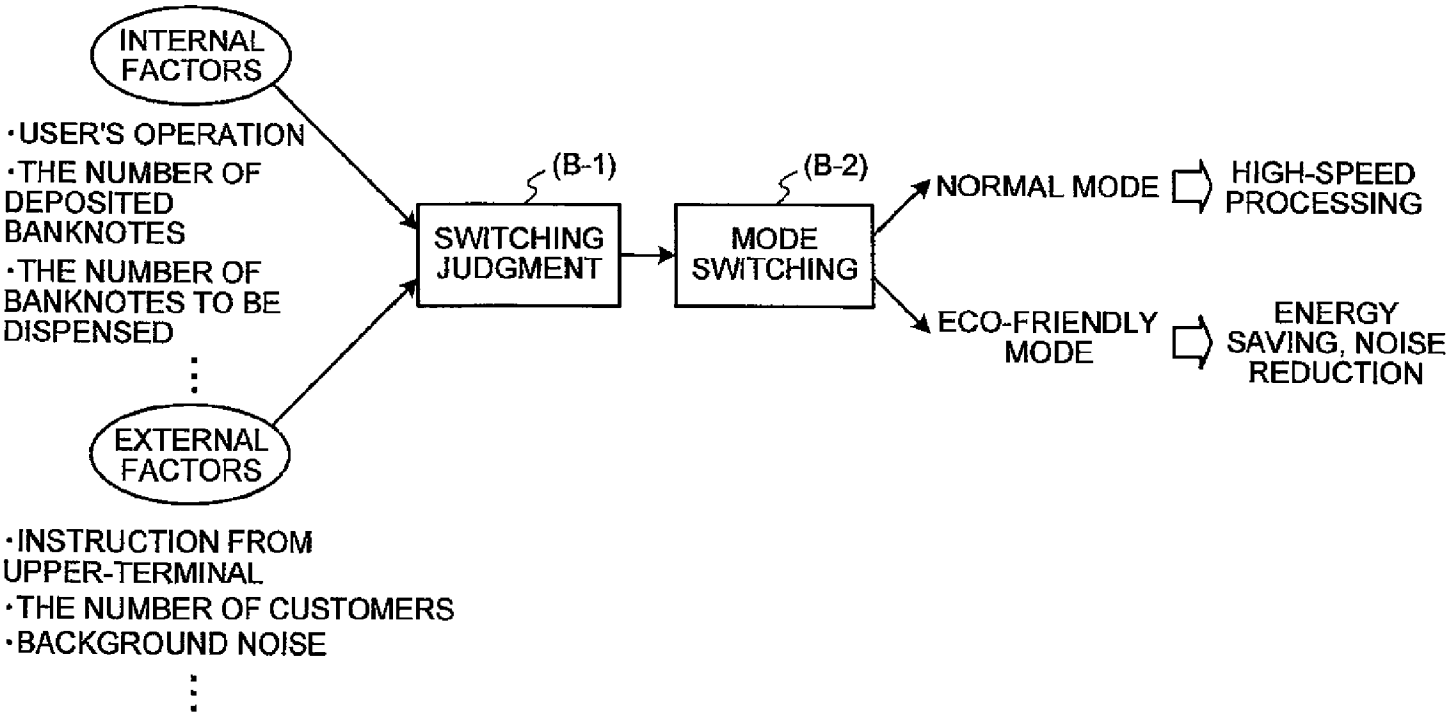

First, before explaining the present embodiment in detail, an overview of the banknote handling technique according to the present embodiment is explained with reference to FIGS. 17A and 17B. FIGS. 17A and 17B are diagrams showing the overview of the banknote handling technique according to the present embodiment. FIG. 17A shows two operation modes used in the banknote handling technique according to the present embodiment, while FIG. 17B shows the operation of switching the operation modes.

As shown in FIGS. 17A and 17B, the characteristic feature of the banknote handling method according to the present invention resides in that both high-speed processing and low environmental burden can be realized by incorporating different operation modes that have different banknote transport speeds and feeding speeds.

More specifically, as shown in FIG. 17A, with the banknote handling technique according to the present invention, the banknote handling apparatus is provided with two operation modes, "normal mode" and "eco-friendly mode". The "normal mode" indicates an operation mode in which the transport path that transports banknotes and the feeding unit that feeds the banknotes to the transport path are driven at regular transport speed and feeding speed. On the other hand, the "eco-friendly mode" indicates an operation mode in which the transport path and the feeding unit are driven at transport speed and feeding speed lower than in the normal mode.

In other words, when the operation mode is the normal mode, the transport path and the feeding unit are driven at a transport speed and a feeding speed higher than in the eco-friendly mode. Therefore, the banknote depositing and dispensing processes can be performed more speedily than in the eco-friendly mode.

On the other hand, when the operation mode is the eco-friendly mode, the transport path and the feeding unit are driven at a speed lower than in the normal mode. If the transport path and the feeding unit are driven at a speed lower than in the normal mode, the frictional force and the like applied to the driving unit such as the motor and the actuator in the banknote handling apparatus is reduced. This can reduce an energy loss in comparison with the normal mode. Power savings can therefore be achieved by driving the transport path and the feeding unit in the eco-friendly mode.

Moreover, when the operation mode is the eco-friendly mode, the rotating speed of the rotating units such as the rollers that drive the transport path and the feeding unit and a stacking wheel (hereinafter, "elastic fin wheel") that collects the transported banknotes in an aligned manner are reduced. For this reason, the frequency of the noise produced by these rotating units decreases, and the sound pressure level decreases. Thus, the level of noise generated by the banknote handling apparatus can be reduced. In other words, noise reduction can also be achieved by driving the transport path and the feeding unit in the eco-friendly mode.

In this manner, with the banknote handling technique according to the present invention, the operation mode is switched between the normal mode (third mode) of driving the transport path and the feeding unit at the first speed and the eco-friendly mode (fourth mode) of driving the transport path and the feeding unit at the second speed that is lower than the first speed, and the transport path and the feeding unit are driven at speeds corresponding to the switched operation mode. As a result, both high-speed processing and low environmental burden can be realized in the banknote handling apparatus.

With the banknote handling technique according to the present embodiment, when the operation mode is the eco-friendly mode, the rotating speed of the rotating units decreases, which suppresses the wear-out of the units. As a result, the lifespan of the consumable parts and the banknote handling apparatus itself can be increased. The low environmental burden can be achieved also from this aspect.

With the banknote handling technique according to the present invention, those operation modes are switched in accordance with various factors. More specifically, with the banknote handling technique according to the present invention, as shown in FIG. 17B, switching timing of the operation mode is judged, based on a factor generated in the banknote handling apparatus itself (internal factor) and a factor from the outside of the banknote handling apparatus (external factor) (see (B-1) of FIG. 17B). With the banknote handling technique according to the present invention, the operation mode is switched to the normal mode or to the eco-friendly mode, in accordance with the switching judgment result (see (B-2) of FIG. 17B).

With the banknote handling technique according to the present invention, the operation mode can be switched in accordance with the mode switching instruction issued by the user or in accordance with the number of deposited banknotes or dispensed banknotes, as an internal factor. For example, with the banknote handling technique according to the present invention, if a large number of banknotes are inserted into the banknote handling apparatus, or if a large number of banknotes are to be dispensed from the banknote handling apparatus, the operation mode can be switched to the normal mode so that the large number of banknotes can be processed at high speed.

On the other hand, if the number of banknotes deposited to the banknote handling apparatus or the number of banknotes to be dispensed from the banknote handling apparatus is relatively small, the operation mode can be switched to the eco-friendly mode so that the banknotes can be processed while achieving power savings and noise reduction. In this manner, the operation mode is switched to a suitable one in accordance with the number of processing target banknotes, and thereby both high-speed processing and low environmental burden can be realized without hampering the convenience for the user.

With the banknote handling technique according to the present invention, the operation mode can be switched in accordance with a remote instruction from an upper terminal connected to the banknote handling apparatus, and also in accordance with the number of customers of a store in which the banknote handling apparatus is installed, the noise level surrounding the banknote handling apparatus, and the like, as external factors. The details of these will be discussed later in this embodiment.

In the above explanation, the low environmental burden is realized by reducing the driving speeds of the transport path and the feeding unit; however, the method for realizing the low environmental burden is not limited thereto. For example, with the banknote handling technique according to the present invention, when the operation mode is the eco-friendly mode, lighting control can also be incorporated by reducing the lighting time or dimming the lighting for various operation buttons and a lighting unit such as a backlight of the display unit. In this manner, the power consumption can be further reduced. Moreover, when the operation mode is the eco-friendly mode, the period of time before going into power-saving mode (sleep mode) can be shortened.

In the above explanation, the operation modes include two modes, the normal mode and the eco-friendly mode; however, the operation modes are not limited thereto. The operation modes can include three modes or more. Moreover, the transport speed and the feeding speed for each operation mode can be determined by the user, as desired, by changing a corresponding setting. In such a situation, if the consumption power reduction rate or the noise reduction rate corresponding to the determined transport speed and feeding speed is displayed onto the display unit, the user can check an expected level of power saving or noise reduction, while setting the transport speed and the feeding speed.

A banknote handling apparatus adopting the banknote handling technique explained with respect to FIG. 17 is explained in detail below. In the following explanation, the banknote handling apparatus 1 explained with reference to FIG. 2 is used as an example of the banknote handling apparatus. The banknote handling apparatus 1 according to the present embodiment can be applied not only to a banknote handling apparatus, but also a coin handling apparatus for performing coin depositing/dispensing processes and a banknote handling apparatus for performing coin and banknote depositing/dispensing processes. The banknote handling apparatus 1 according to the present embodiment can also be applied to a depositing handling apparatus for performing only a banknote depositing process and a dispensing handling apparatus for performing only a banknote dispensing process. The functions and operations of the banknote handling apparatus 1 explained in the first embodiment are omitted from the explanation. Similarly, the functions and operations of the units included in the apparatus 1 are explained in the first embodiment, and thus the detailed explanation is omitted here. The functions and operations of the apparatus 1 according to the third embodiment that are different from the first embodiment are explained in detail below.

Figure 18:
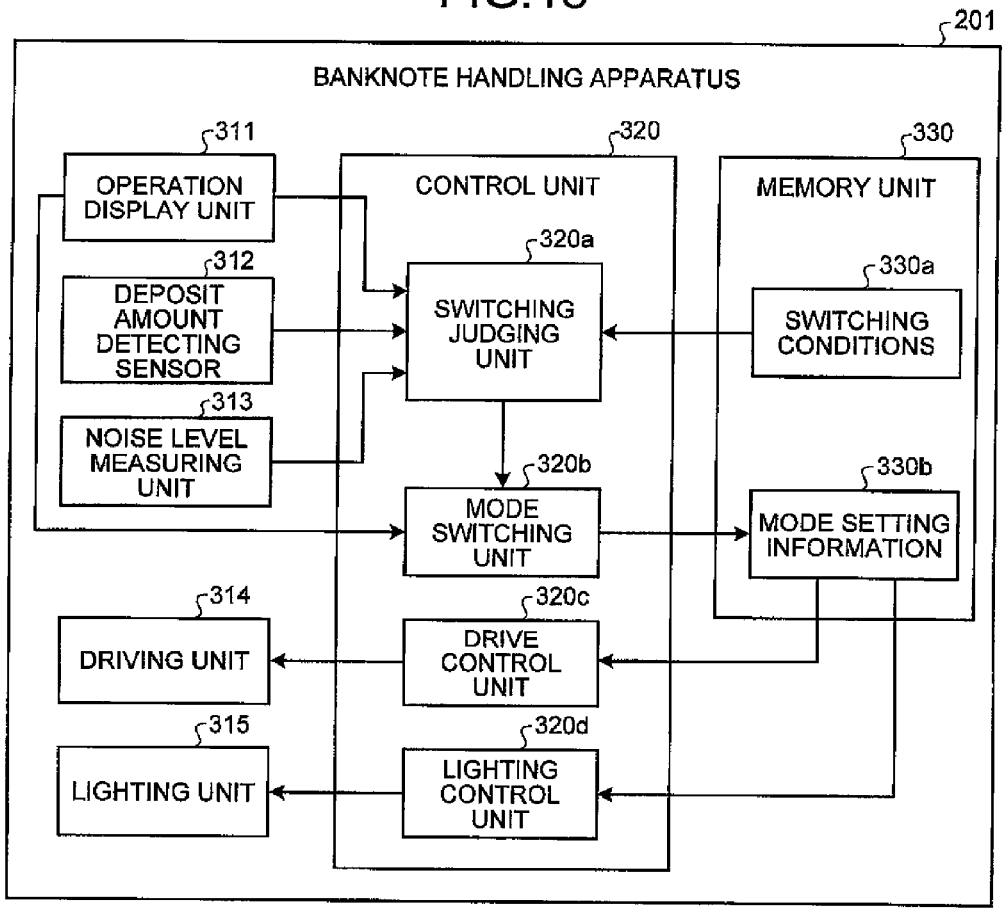
FIG. 18 is a block diagram showing a functional structure of the banknote handling apparatus according to the third embodiment.

First, the functional structure of the banknote handling apparatus 1 according to the present embodiment is explained with reference to FIG. 18. FIG. 18 is a block diagram showing the functional structure of the banknote handling apparatus according to the present embodiment. Only structural elements that are necessary for explaining the features of the banknote handling apparatus 1 are described in FIG. 18, and the general structural elements explained with reference to FIG. 3 are omitted from the description.

As shown in FIG. 18, the banknote handling apparatus 1 according to the present embodiment includes an operation display unit 311, a deposit amount detecting sensor 312, a noise level measuring unit 313, a driving unit 314, a lighting unit 315, a control unit 320, and a memory unit 330. The control unit 320 includes a switching judging unit 320*a*, a mode switching unit 320*b*, a drive control unit 320*c*, and a lighting control unit 320*d*, and the memory unit 330 that stores therein switching conditions 330*a* and mode setting information 330*b*.

The operation display unit 311 includes an input device that receives various operations from the user and a display that displays various kinds of information. More specifically, the operation display unit 311 receives a mode switching operation, a dispensing operation for dispensing the banknotes stored in the stackers 18*a* to 18*e*, and the like.

Upon receiving a mode switching operation or a dispensing operation, the operation display unit 311 sends the switching judging unit 320*a* a mode switching instruction and a dispensing instruction. The mode switching instruction includes information indicating which of the normal mode and the eco-friendly mode the operation mode is switched to. Furthermore, the dispensing instruction includes information indicating how many banknotes of which denomination should be dispensed. The mode switching operation can be performed on a predetermined setting screen, or by pressing buttons dedicated to mode switching.

Upon receiving an operation of changing various parameters in relation to the eco-friendly mode, the operation display unit 311 sends the mode switching unit 320*b* that the change operation has been performed. Furthermore, upon receiving a deposit start operation of the banknotes inserted into the banknote handling apparatus 1 or a dispensing operation, the operation display unit 311 sends the drive control unit 320*c* the deposit start instruction and the dispensing instruction.

The deposit amount detecting sensor 312 detects an approximate number of banknotes inserted into the banknote handling apparatus 1. The deposit amount detecting sensor 312 sends the switching judging unit 320*a* that a detection result indicating the weight of the banknotes mounted on the banknote handling apparatus 1 or the height of the banknotes mounted on the banknote handling apparatus 1 is greater than or equal to a predetermined value.

The noise level measuring unit 313 measures the surrounding noise level using a sound collecting unit arranged at a predetermined position around the periphery of the banknote handling apparatus 1, and sends the switching judging unit 320*a* a measured noise level. It is preferable that the noise level measuring unit 313 should measure the surrounding noise level, only when the banknote handling apparatus 1 is not performing a depositing handling or a dispensing process. This is because, when the banknote handling apparatus 1 is performing a depositing process or a dispensing process, the surrounding noise may not be accurately measured.

The driving unit 314 drives the transport path 16, the feeding unit, the elastic fin wheel, and the like, and is controlled by the drive control unit 320*c*. The lighting unit 315 illuminates various operation buttons and the display arranged in the operation display unit 311, and controlled by the lighting control unit 320*d*.

The control unit 320 is a processing unit that performs the switching judgment and switching of the operation mode, the driving control of the driving unit 314, and the lighting control of the lighting unit 315. The switching judging unit 320*a* is a processing unit that determines whether the operation mode should be switched, by comparing information, which is received from the operation display unit 311, the deposit amount detecting sensor 312, and the noise level measuring unit 313, with the switching conditions stored in the memory unit 330. Upon judging that the operation mode needs to be switched, the switching judging unit 320*a* issues the operation mode switching instruction to the mode switching unit 320*b*.

An operation example of the switching judging process performed by the switching judging unit 320*a* is explained now with reference to FIG. 19. FIG. 19 is a diagram showing examples of conditions for switching to the eco-friendly mode. As shown in FIG. 19, the switching judging unit 320*a* switches the operation mode in accordance with the mode switching operation performed by the operation display unit 311 (see (T1) in FIG. 19). More specifically, upon receiving a mode switching instruction from the operation display unit 311, the switching judging unit 320*a* sends an instruction to the mode switching unit 320*b* to switch to an operation mode corresponding to the mode switching instruction.

The switching judging unit 320*a* can judge the switching timing of the operation mode in accordance with the day of the week or the time of day (see (T2) in FIG. 19). More specifically, the days of the week or the time of day are associated with the operation modes, and stored as the switching conditions 330*a* in the memory unit 330. Then, when the day of the week or the time of day changes, the switching judging unit 320*a* refers to the switching conditions 330*a* and sends an instruction to the mode switching unit 320*b* to switch to an operation mode corresponding to the current day of the week and current time of day.

The normal mode is adopted on days of the week or during the time of day when there are a large number of customers, and the eco-friendly mode is adopted on other days or time. This can prevent the turnover of the customers from being lowered by driving in the eco-friendly mode when many customers are visiting, or electric power from being wasted by driving in the normal mode when there are only a few customers. Furthermore, a noise level generated by the banknote handling apparatus 1 can be reduced by driving the banknote handling apparatus 1 in the eco-friendly mode.

As described above, when the current time and day satisfy the predetermined condition, the operation mode is switched to the eco-friendly mode. Thus, the operation mode can be switched automatically at suitable timing that is predetermined in accordance with the situations of the retail stores in which the banknote handling apparatus 1 is installed.

Moreover, the switching judging unit 320*a* can judge the switching timing of the operation mode in accordance with the amount of inserted banknotes (see (T3) in FIG. 19). More specifically, the memory unit 330 stores therein the threshold values of the weights of the banknotes inserted into the banknote handling apparatus 1, as the switching conditions 330*a*. Upon receiving information regarding the weight of the banknotes from the deposit amount detecting sensor 312, the switching judging unit 320*a* sends an instruction to the mode switching unit 320*b* to switch to the eco-friendly mode if the weight of the banknotes indicated in the received information is less than or equal to the threshold value.

As described above, the operation mode is switched to the eco-friendly mode when the weight of money detected by the deposit amount detecting sensor 312 is less than or equal to the predetermined amount, so that power saving and noise reduction can be achieved while performing a process on the money.

On the other hand, when the weight of the banknotes indicated in the received information is greater than the above threshold value, the switching judging unit 320*a* sends an instruction to the mode switching unit 320*b* to switch to the normal mode. In other words, when a large number of banknotes are inserted into the banknote handling apparatus 1, the operation mode is switched to the normal mode so that this large number of banknotes can be processed at high speed.

When the deposit amount detecting sensor 312 is an infrared sensor that detects the height of the banknotes accumulated in the banknote handling apparatus 1 being greater than or equal to a predetermined height, upon receiving such detection results from the deposit amount detecting sensor 312, the switching judging unit 320*a* sends an instruction to the mode switching unit 320*b* to switch to the normal mode.

Moreover, the switching judging unit 320*a* can judge the switching timing of the operation mode in accordance with the number of fed-out banknotes (see (T4) in FIG. 19). More specifically, the memory unit 330 stores therein the threshold value of the banknotes to be dispensed in the outlet 13, as the switching conditions 330*a*. Upon receiving a dispensing instruction from the operation display unit 311, the switching judging unit 320*a* sends an instruction to the mode switching unit 320*b* to switch to the eco-friendly mode if the number of dispensing banknotes included in the received dispensing instruction is smaller than or equal to the threshold value.

On the other hand, the switching judging unit 320*a* sends an instruction to the mode switching unit 320*b* to switch to the normal mode if the number of dispensing banknotes included in the received dispensing instruction is greater than the threshold value. In this manner, by switching to a suitable operation mode in accordance with the weight or number of processing target banknotes, high-speed processing in the normal mode and a low environmental burden in the eco-friendly mode can both be achieved, without hampering the user's convenience.

The switching judging unit 320*a* can judge the switching timing of the operation mode in accordance with the noise level (environmental noise level) measured around the apparatus by the noise level measuring unit 313 (see (T5) in FIG. 19). More specifically, the memory unit 330 stores therein the threshold value for the noise level as one of the switching conditions 330*a*. When the noise level received from the noise level measuring unit 313 is smaller than or equal to the threshold value, the switching judging unit 320*a* sends an instruction to the mode switching unit 320*b* to switch to the eco-friendly mode.

On the other hand, when the noise level received from the noise level measuring unit 313 is greater than the threshold value, the switching judging unit 320*a* sends an instruction to the mode switching unit 320*b* to switch to the normal mode. In this manner, when the noise level measured by the noise level measuring unit 313 is smaller than or equal to a predetermined value, the operation mode is switched to the eco-friendly mode, and thereby the noise reduction can be realized at suitable timing.

In FIG. 18, the mode switching unit 320*b* is now explained. The mode switching unit 320*b* is a processing unit that, upon receiving an instruction from the switching judging unit 320*a* to switch the operation mode, updates the mode setting information 330*b* and thereby switches the operation mode between the normal mode and the eco-friendly mode. The mode setting information 330*b* is explained now with reference to FIG. 20. FIG. 20 is a diagram showing an example of the mode setting information 330*b*.

As shown in FIG. 20, the mode setting information 330*b* includes items of "transport speed", "feeding speed", "lighting level", "lighting duration", and "setting flag" that are associated with each "operation mode". The item of "transport speed" includes information regarding the banknote transport speed of the transport path 16. FIG. 20 shows "1600 mm/second" stored in association with "normal mode", and "1200 mm/second" stored in association with "eco-friendly mode".

Furthermore, the item of "feeding speed" includes information regarding the banknote feeding speed of the feeding unit. In FIG. 20, "10 banknotes/second" is stored in association with "normal mode", and "7 banknotes/second" is stored in association with "eco-friendly mode". As can be seen from the above, the transport speed and the feeding speed lower than those of the normal mode are associated with the eco-friendly mode.

The item of "lighting level" includes information regarding the brightness of the lighting of the lighting unit 315. In FIG. 20, "bright" is stored in association with "normal mode", and "dark" is stored in association with "eco-friendly mode".

Furthermore, the item of "lighting duration" includes information regarding the lighting time of the lighting unit 315. In FIG. 20, "10 seconds" is stored in association with "normal mode", "5 seconds" is stored in association with "eco-friendly mode". In this manner, the lighting level lower than that of the normal mode and the lighting time shorter than that of the normal mode are associated with the eco-friendly mode.

Still further, the item of "setting flag" includes flag information that indicates the currently set operation mode. In FIG. 20, "yes" is stored in association with "normal mode", while "no" is stored in association with "eco-friendly mode". This means that the currently set operation mode is "normal mode".

Upon receiving an instruction from the switching judging unit 320*a* to switch the operation mode, the mode switching unit 320*b* switches the operation mode by updating the item of "setting flag" in the mode setting information 330*b*.

The parameters such as "transport speed", "feeding speed", "lighting level", and "lighting duration" corresponding to the eco-friendly mode in FIG. 20 can be changed by the user, as desired. More specifically, upon receiving a parameter change operation, the operation display unit 311 sends the mode switching unit 320*b* that the change operation has been performed. Then, the mode switching unit 320*b* changes the parameters of the mode setting information 330*b*, in accordance with the information received from the operation display unit 311.

Figures 21A, 21B:
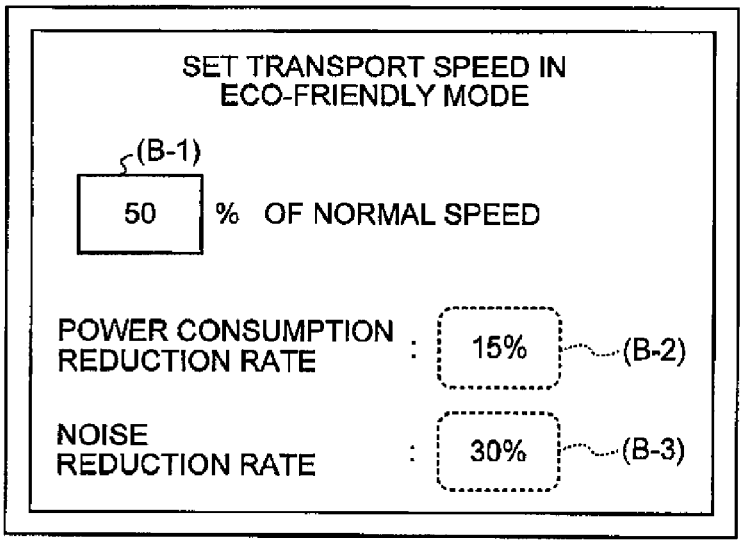
FIGS. 21A and 21B are diagrams showing an example of a parameter setting change operation.

The power consumption reduction rate or the noise reduction rate corresponding to the set transport speed and the set feeding speed can be displayed onto the operation display unit 311. This aspect is explained below with reference to FIGS. 21A and 21B. FIGS. 21A and 21B are diagrams showing an example of the parameter setting change operation.

An operation for changing the setting of the transporting speed is explained here as an example. FIG. 21A shows actual measurement data regarding the power consumption and the noise level corresponding to each transport speed, and FIG. 21B shows an example of an operation mode setting screen.

As shown in FIG. 21A, the memory unit 330 stores therein the items of "power consumption", "power consumption reduction rate", "noise level", and "noise reduction rate" for each transport speed of the transport path 16. For the item of "power consumption", actual measurement data regarding the entire power consumption of the banknote handling apparatus 1 when running the transport path 16 at a corresponding transport speed is stored. For the item of "power consumption reduction rate", information regarding the reduction rate of the power consumption when the power consumed at the transport speed of "1600 mm/second" is expressed as 100% is stored.

For the item of "noise level", actual measurement data regarding the noise level of the banknote handling apparatus 1 generated when running the transport path 16 at the corresponding transport speed is stored. Furthermore, for the item of "noise reduction rate", information regarding the reduction rate of the noise level when the noise level at the transport speed of "1600 mm/second" is expressed as 100% is stored.

When the user changes the setting of the transport speed, the power consumption reduction rate and the noise reduction rate corresponding to the set transport speed are displayed onto the operation display unit 311, as shown in FIG. 21B. For example, the user sets the transport speed in the eco-friendly mode to 50% of the transport speed in the normal mode (1600 mm/sec), in other words, to 800 mm/second (see (B-1) in FIG. 21B). Then, the power consumption reduction rate "15%" and the noise reduction rate "30%" corresponding to the set transport speed of 800 mm/second are displayed onto the operation display unit 311 (see (B-2) and (B-3) in FIG. 21B).

As described above, by displaying the power consumption reduction rate and the noise reduction rate corresponding to the set transport speed onto the operation display unit 311, the user can check how much power can be saved or how much noise can be reduced, while performing a setting change operation.

In FIG. 18, the drive control unit 320*c* is now explained. The drive control unit 320*c* is a processing unit that, upon receiving a deposit start instruction or a dispensing instruction from the operation display unit 311, drives the driving unit 314 at the transport speed and the feeding speed corresponding to the currently set operation mode by referring to the mode setting information 330*b*.

More specifically, when the setting flag "yes" is set for "normal mode", the drive control unit 320*c* causes the driving unit 314 to drive the transport path 16 at the transport speed of 1600 mm/second and the feeding unit to feed the banknotes at the feeding speed of 10 banknotes/second. On the other hand, when the setting flag "yes" is set for "eco-friendly mode", the drive control unit 320*c* causes the driving unit 314 to drive the transport path 16 at the transport speed of 1200 mm/second and the feeding unit to feed the banknotes at the feeding speed of 7 banknotes/second.

The lighting control unit 320*d* is a processing unit that, when some operation is executed onto the operation display unit 311, refers to the mode setting information 330*b* and illuminates the lighting unit 315 to a lighting level and for a length of lighting time corresponding to the currently set operation mode.

More specifically, when the setting flag "yes" is set for "normal mode", the lighting control unit 320*d* illuminates the operation buttons and the display of the operation display unit 311 at the lighting level "bright" for "10 seconds". On the other hand, when the setting flag "yes" is set for "eco-friendly mode", the lighting control unit 320*d* illuminates the operation buttons and the display of the operation display unit 311 at the lighting level "dark" for "5 seconds".

As described above, when the operation mode is the eco-friendly mode, the lighting level of the operation display unit 311 is lower and the lighting time thereof is shorter than when the operation mode is the normal mode, and therefore electric power can be further saved in the eco-friendly mode. When the operation mode is the eco-friendly mode, the period of time before going into the power-saving mode (sleep mode) can be reduced, and the electric power can thereby be still further saved.

Figure 22:
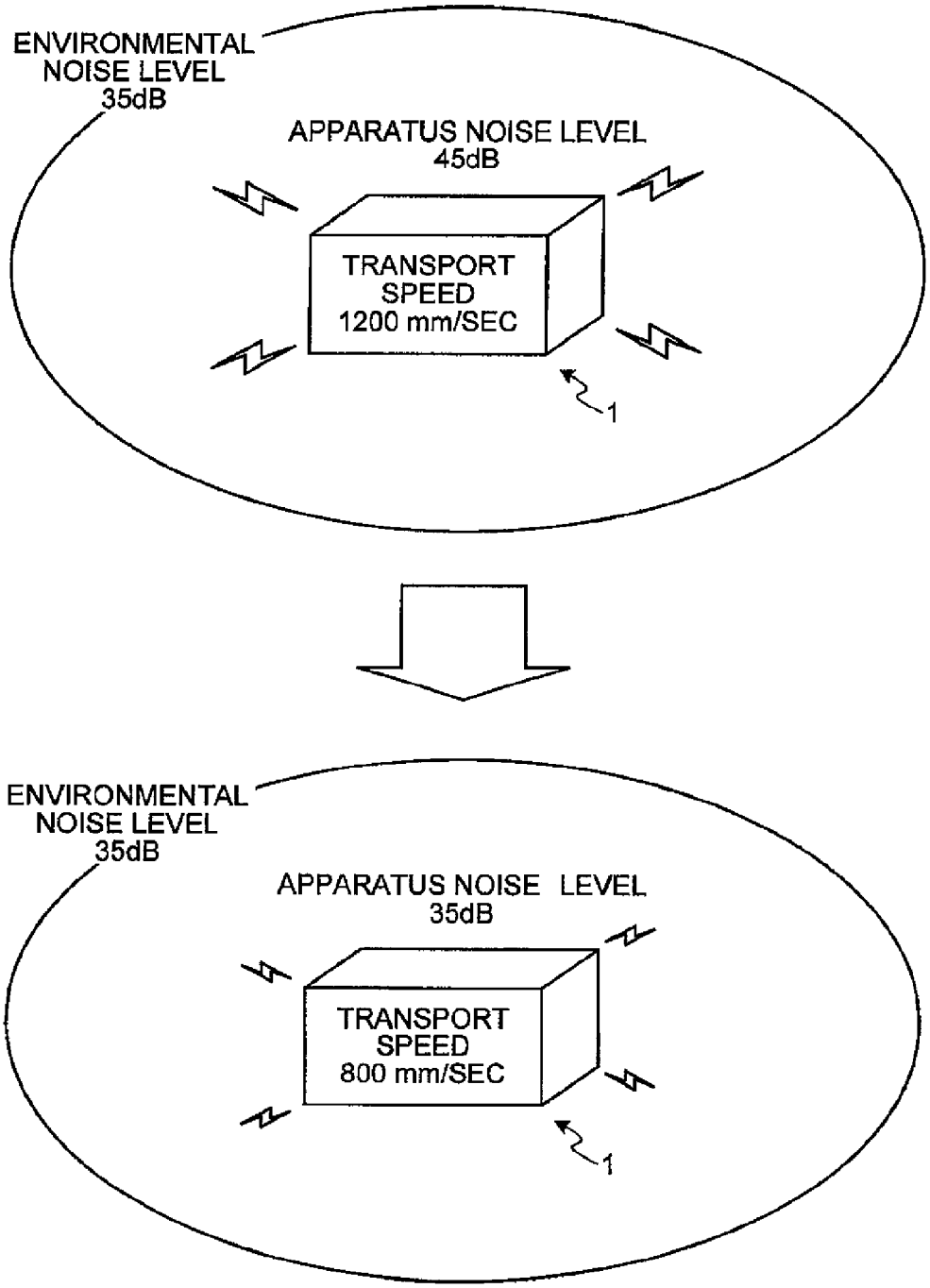
FIG. 22 is a diagram showing another operation example of a mode switching unit.

The parameters of the eco-friendly mode that are changed in response to the user's operation are explained above, but they are not limited thereto. For example, the parameters of the eco-friendly mode can be changed in accordance with the surrounding noise level. This aspect is explained below with reference to FIG. 22. FIG. 22 is a diagram showing another operation example performed by the mode switching unit. FIG. 22 shows the transport speed that is changed in accordance with the surrounding noise level, as an example.

As shown in FIG. 22, the mode switching unit 320*b* recognizes that the noise level of the banknote handling apparatus 1 is 45 dB when the transport path 16 runs at a transport speed of 1200 mm/second, based on the actual measurement data in FIG. 21A. As shown in FIG. 22, the noise level, around the apparatus, measured by the noise level measuring unit 313 is 35 dB when the banknote handling apparatus 1 is not executing a depositing process or a dispensing process.

In such a situation, the mode switching unit 320*b* refers to the actual measurement data in FIG. 21A, and changes the transport speed of the eco-friendly mode to the transport speed of 800 mm/second so that the noise level of the banknote handling apparatus 1 coincides with the surrounding noise level of 35 dB.

As described above, the levels of noise generated when running the transport path 16 at different transport speeds are stored in advance in association with the transport speeds. When the noise level measured by the noise level measuring unit 313 is lower than the noise level corresponding to the transport speed in the eco-friendly mode, the transport speed is changed to drive the transport path 16 at a transport speed corresponding to the noise level measured by the noise level measuring unit 313. The noise level generated by the banknote handling apparatus 1 can thereby be lowered in accordance with the surrounding circumstances.

Figure 23:
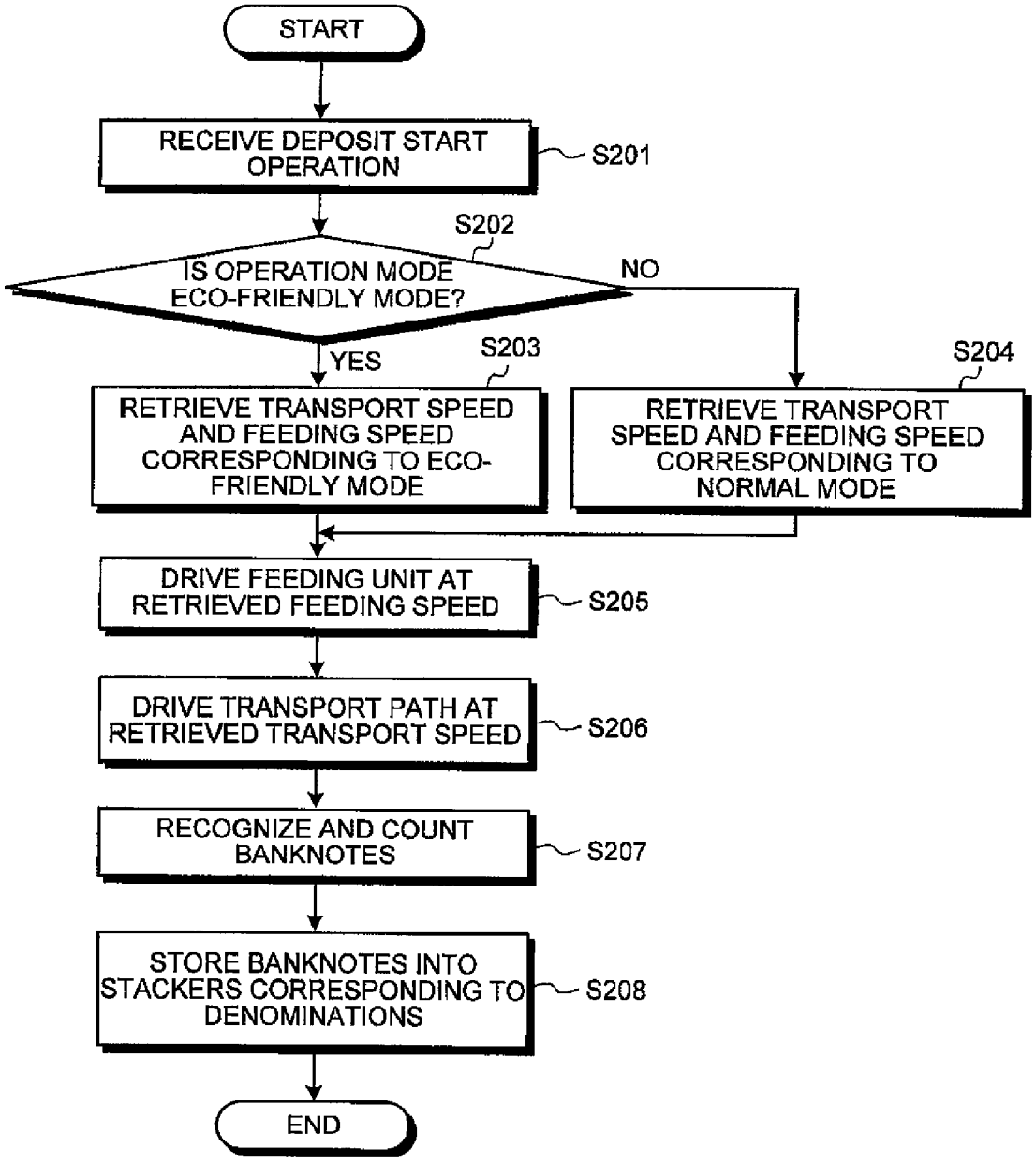
FIG. 23 is a flowchart of the process procedure performed by the banknote handling apparatus according to a third embodiment.

Next, the specific operation of the banknote handling apparatus 1 according to the present embodiment is explained with reference to FIG. 23. FIG. 23 is a flowchart of the process procedure performed by the banknote handling apparatus 1. FIG. 23 shows the process procedure up to the operation of storing the banknotes inserted into the banknote handling apparatus 1 to the stackers 18*a* to 18*e*, each of which is for stacking different denomination.

As shown in FIG. 23, when the operation display unit 311 receives a deposit start operation (Step S201), the drive control unit 320*c* determines whether the operation mode is the eco-friendly mode, by referring to the mode setting information 330*b* (Step S202). When determining that the operation mode is the eco-friendly mode (Yes at Step S202), the drive control unit 320*c* retrieves the transport speed and the feeding speed corresponding to the eco-friendly mode from the mode setting information 330*b* (Step S203).

On the other hand, when the operation mode is not the eco-friendly mode (No at Step S202), the drive control unit 320*c* retrieves the transport speed and the feeding speed corresponding to the normal mode from the mode setting information 330*b* (Step S204).

Subsequently, the drive control unit 320*c* drives the feeding unit of the banknote handling apparatus 1 at the feeding speed retrieved from the mode setting information 330*b* (Step S205), and drives the transport path 16 at the transport speed retrieved from the mode setting information 330*b* (Step S206).

Next, the recognizing and counting unit 12 recognizes and counts the banknotes transported by the transport path 16 (Step S207). Then, the banknote handling apparatus 1 stores the banknotes into the stackers 18*a* to 18*e* corresponding to each denomination, in accordance with the recognition result obtained by the recognizing and counting unit 12 (Step S208), and terminates the process.

As discussed above, according to the present embodiment, the mode switching unit switches the operation mode between the third mode (normal mode) in which the transport path is driven at the first transport speed and the fourth mode (eco-friendly mode) in which the transport path is driven at the second transport speed that is lower than the first transport speed, and the drive control unit drives the transport path at the transport speed corresponding to the operation mode switched by the mode switching unit. Thus, high-speed processing and low environmental burden can both be achieved.

Figure 24:
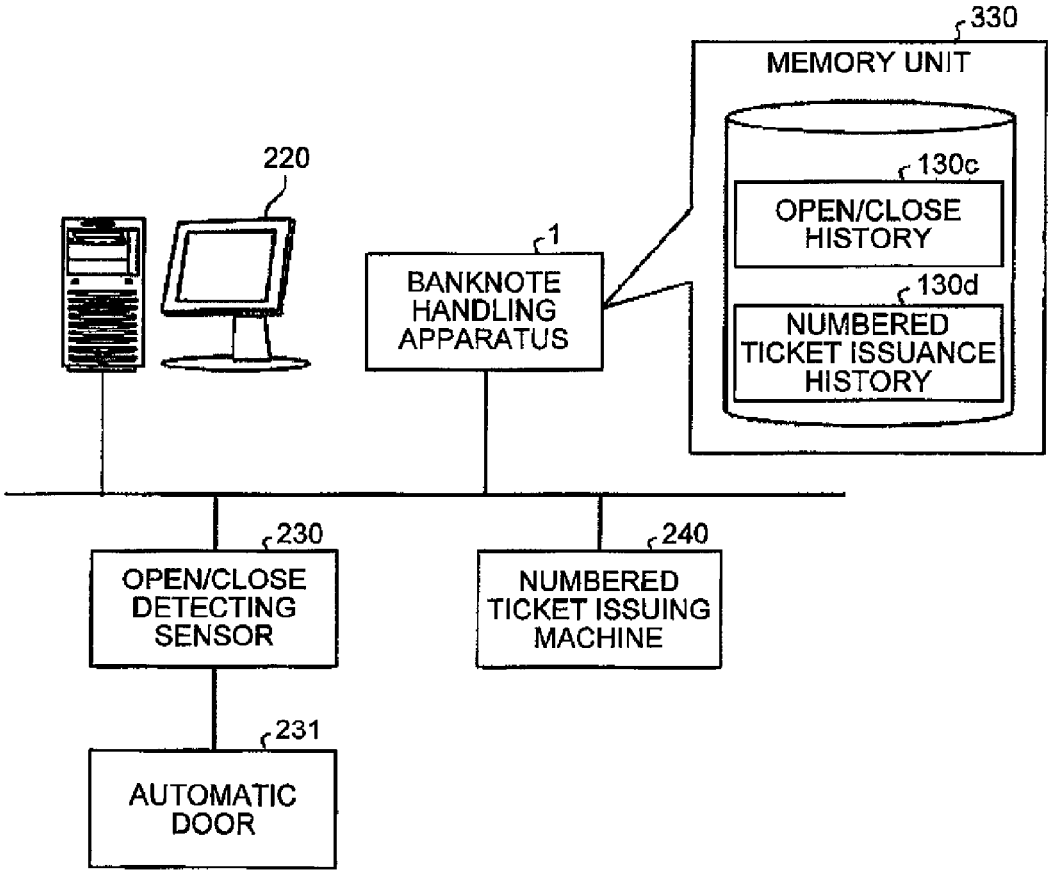
FIG. 24 is a diagram of a network structure that includes the banknote handling apparatus according to the third embodiment.

According to the present embodiment, the switching of the operation mode based on the information input from the units of the banknote handling apparatus 1 (e.g., the operation display unit 311, the deposit amount detecting sensor 312, and the noise level measuring unit 313) is explained above;

however, the switching method is not limited thereto. For example, the switching of the operation mode can be judged based on the information inputted from the outside of the banknote handling apparatus 1. This aspect is explained below. FIG. 24 is a diagram showing a network structure including the banknote handling apparatus 1 according to the present embodiment.

As shown in FIG. 24, the banknote handling apparatus 1 is connected to a managing device 220, an open/close detecting sensor 230, and a numbered ticket issuing machine 240 via a network such as an in-store local area network (LAN).

The managing device 220 manages various devices installed in a retail store. The open/close detecting sensor 230 detects the open/close state of the automatic door 231 arranged at the entrance of the retail store. Upon detecting the open/close state of the automatic door, this open/close detecting sensor 230 sends the banknote handling apparatus 1 the open/close detection result including the detection time via the in-store LAN. The numbered ticket issuing machine 240 is installed in the retail store to issue a numbered ticket to each customer who visits the retail store. When issuing the numbered ticket, this numbered ticket issuing machine 240 sends the banknote handling apparatus 1 the numbered ticket issuance information including the issuance time via the in-store LAN.

The memory unit 330 of the banknote handling apparatus 1 stores therein an open/close history 130*c* and a numbered ticket issuance history 130*d*. The open/close history 130*c* is history information of the open/close detection result of the automatic door 231 received from the open/close detecting sensor 230. The numbered ticket issuance history 130*d* is a history of the numbered ticket issuance information received from the numbered ticket issuing machine 240.

The banknote handling apparatus 1 stores therein the open/close history 130*c* and the numbered ticket issuance history 130*d*; however, the storage destination is not limited thereto. The open/close history 130*c* and the numbered ticket issuance history 130*d* can be stored in the managing device 220.

The banknote handling apparatus 1 judges the switching timing of the operation mode, based on an instruction from the managing device 220, or on the open/close history 130*c* and the numbered ticket issuance history 130*d* stored in the memory unit 330. An operation example of the switching judging unit 320*a* in this situation is explained, where the conditions of switching to the eco-friendly mode are an instruction from the managing device (T6), the frequency of the automatic door being open or close (T7), and the frequency of the numbered ticket issuance (T8).

The switching judging unit 320*a* can judge the switching timing of the operation mode, in accordance with the mode switching instruction sent from the managing device 220 via the in-store LAN (T6). More specifically, the operator of the managing device 220 monitors the crowded condition of the retail store by a security camera or the like installed in the retail store. When the retail store is crowded, the operator can send the banknote handling apparatus 1 the mode switching instruction including information that the operation mode should be switched to the normal mode, by using the managing device 220.

The switching judging unit 320*a* can judge the switching timing of the operation mode in accordance with the frequency of the opening and closing of the automatic door 231 (T7). More specifically, the memory unit 330 stores therein the threshold value for the number of opening and closing of the automatic door 231 within a predetermined period of time (i.e., the frequency of the opening/closing of the automatic door 231) as one of the switching conditions 330*a*. The switching judging unit 320*a* calculates the frequency of opening/closing of the automatic door 231 using the open/close history 130*c* in the memory unit 330. When the calculated opening/closing frequency is less than or equal to the threshold value, the switching judging unit 320*a* sends an instruction to the mode switching unit 320*b* to switch to the eco-friendly mode.

On the other hand, when the calculated opening/closing frequency exceeds the above threshold value, the switching judging unit 320*a* sends an instruction to the mode switching unit 320*b* to switch to the normal mode. In this manner, the operation mode is switched to the eco-friendly mode upon judging that the opening/closing frequency of the automatic door 231 is smaller than or equal to the predetermined frequency, based on the open/close history 130*c* of the automatic door 231. When the retail store is not crowded, driving in the eco-friendly mode can be adopted to achieve a low environmental burden, while when the retail store is crowded, driving in the normal mode can be adopted so that the banknotes can be processed at high speed.

The open/close detecting sensor is arranged in the automatic door 231; however, the detecting method is not limited thereto. A human detecting sensor can be installed in the vicinity of the automatic door 231, and the switching of the operation mode can be performed based on the detection result by the human detecting sensor.

The switching judging unit 320*a* can judge the switching timing of the operation mode in accordance with the issuance frequency of the numbered tickets (T8). More specifically, the memory unit 330 stores therein, as one of the switching conditions 330*a*, the threshold value for the number of issuances of numbered tickets within a predetermined length of time (i.e. the frequency of the issuance of the numbered tickets). The switching judging unit 320*a* calculates the frequency of issuance of numbered tickets using the numbered ticket issuance history 130*d* in the memory unit 330, and when the calculated issuance frequency is less than or equal to the above threshold value, the switching judging unit 320*a* sends an instruction to the mode switching unit 320*b* to switch to the eco-friendly mode.

On the other hand, when the calculated issuance frequency exceeds the threshold value, the switching judging unit 320*a* sends an instruction to the mode switching unit 320*b* to switch to the normal mode. In this manner, when the frequency of the issuance of the numbered tickets is judged as being less than or equal to the predetermined frequency, based on the numbered ticket issuance history 130*d*, the operation mode is switched to the eco-friendly mode. In a similar manner to the frequency of opening/closing of the automatic door (T7), driving in the eco-friendly mode can be adopted when the retail store is not crowded so that a low environmental burden can be achieved, while when it is crowded, driving in the normal mode can be adopted so that the banknotes can be processed at high speed.

In this manner, the level of crowded condition of the retail store is identified using the information obtained from various devices installed in the retail store, and the operation mode is switched when the identified level of crowded condition is less than or equal to a predetermined level. This can prevent the turnover of the customers from being dropped by running in the eco-friendly mode when many customers are visiting the retail store, or prevent the electric power from being wasted by running in the normal mode when there are only a few customers. Moreover, the level of noise generated by the banknote handling apparatus 1 can be reduced by driving the banknote handling apparatus 1 in the eco-friendly mode.

INDUSTRIAL APPLICABILITY

As discussed above, the banknote handling apparatus and the banknote handling method according to the present invention are useful for efficiently performing a re-depositing task of rejected banknotes, especially for efficiently performing a re-depositing task of proper banknotes that are rejected by a reject reason such as a transport error and a storage error. Moreover, the banknote handling apparatus and the banknote handling method according to the present invention are also useful when the deposited banknotes should be recognized without being stored or when both high-speed processing and low environmental burden should be achieved.

EXPLANATIONS OF LETTERS OR NUMERALS

1: banknote handling apparatus
11: inlet
12: recognizing and counting unit
13: outlet
14: reject unit
15: escrow unit
15*a*: switchback path
15*b*: tape-type winding unit
16: transport path
17: transport-error detecting sensor
18: storing and feeding unit
18*f*: reconciliation cassette
20, 114: display unit
21: storage-error detecting sensor
111: operation unit
112: recognizing and counting unit
113: diverting unit
120, 320: control unit
120*a*, 320*b*: mode switching unit
120*b*: banknote sorting unit
120*c*: escrowed banknote feeding unit
130, 330: memory unit
130*a*, 330*b*: mode setting information
130*b*: deposit information
311: operation display unit
312: deposit amount detecting sensor
313: noise level measuring unit
314: driving unit
315: lighting unit
320*a*: switching judging unit
320*c*: drive control unit
320*d*: lighting control unit
330*a*: switching condition

The invention claimed is:

1. A banknote handling apparatus that performs a depositing process and/or a dispensing process of a banknote, comprising:

a reject reason identifying unit that identifies a reject reason of a rejected banknote that is determined to be an unacceptable banknote for the depositing process;

a dispensing processing unit that sorts and dispenses a rejected proper banknote, which can be properly handled after being reinserted, and another rejected banknote into different dispensing destinations each of which has an opening to remove banknotes therefrom;

a notifying unit that provides notifying information by which a dispensing destination of the rejected proper banknote can be identified;

a recognition unit that recognizes the banknote;

a storing unit that stores the banknote; and a storage-error detecting unit that detects an error of the storing unit, wherein the dispensing processing unit dispenses, when the recognition unit has recognized the rejected banknote as being proper and the storage-error detecting unit has detected an error of the storing unit corresponding to the rejected banknote, the rejected banknote as the rejected proper banknote separately from the another banknote.

2. The banknote handling apparatus according to claim 1, wherein the notifying unit is a display unit that displays, when the rejected proper banknote is dispensed due to the error of the storing unit, information on operation for the error of the storing unit.

3. A The banknote handling apparatus that performs a depositing process and/or a dispensing process of a banknote, comprising:

a reject reason identifying unit that identifies a reject reason of a rejected banknote that is determined to be an unacceptable banknote for the depositing process;

a dispensing processing unit that sorts and dispenses a rejected proper banknote, which can be properly handled after being reinserted, and another rejected banknote into different dispensing destinations each of which has an opening to remove banknotes therefrom;

a notifying unit that provides notifying information by which a dispensing destination of the rejected proper banknote can be identified;

a recognition unit that recognizes the banknote; and a transport-error detecting unit that detects a transport error of the banknote, wherein the dispensing processing unit dispenses, when the recognition unit has recognized the rejected banknote as being proper and the transport-error detecting unit has detected a transport error of the rejected banknote, the rejected banknote as the proper rejected banknote separately from the another banknote.

4. A banknote handling apparatus comprising:

a transport unit that transports a banknote inside the banknote handling apparatus;

an inlet that stacks the banknote which is fed to the transport unit;

a recognition unit that recognizes a kind of the banknote which is transported by the transport unit;

a plurality of outlets that stack the banknote which is discharged by the transport unit;

an escrow unit that escrows the banknote, which is transported by the transport unit, and feeds an escrowed banknote to the transport path;

a sorting unit that sorts a plurality of banknotes based on the kind of the banknote into at least two transport destinations among the plurality of the outlets and the escrow unit;

an escrowed banknote feeding unit that feeds, when the banknote is being escrowed in the escrow unit, the banknote in the escrow unit toward at least one of the plurality of outlets and the inlet; and a remaining banknote detecting unit that detects a banknote remaining in the inlet and a banknote in each of the plurality of outlets;

wherein the escrowed feeding unit determines a transport destination of the banknote in the escrow unit based on a detection result detected by the remaining banknote detecting unit.

5. The banknote handling apparatus according to claim 4, further comprising:

a display unit that displays information on the banknote sorted by the sorting unit.

6. The banknote handling apparatus according to claim 4, further comprising:

a control unit that sorts the plurality of banknotes based on the kind of the banknote into at least two outlets among the plurality of the outlets; and a notifying unit that provides notifying information on the banknote sorted by the control unit.

7. The banknote handling apparatus according to claim 6, wherein each of the plurality of outlets is a box with an opening formed on a top surface of the banknote handling apparatus and the banknotes can be removed from the opening.

8. The banknote handling apparatus according to claim 6, wherein the transport unit includes a loop-shaped transport path which is connected to the inlet and each of the plurality of outlets.

9. The banknote handling apparatus according to claim 6, wherein the control unit sorts the plurality of banknotes based on reject reasons of each of the plurality of banknotes.

10. The banknote handling apparatus according to claim 6, wherein the control unit sorts the plurality of banknotes based on denominations of each of the plurality of banknotes.

11. The banknote handling apparatus according to claim 6, wherein the control unit sorts the plurality of banknotes based on fitness of each of the plurality of banknotes.

12. The banknote handling apparatus according to claim 6, wherein the control unit sorts the plurality of banknotes based on authenticity of each of the plurality of banknotes.

13. The banknote handling apparatus according to claim 6, wherein the control unit sorts the plurality of banknotes based on face/back orientation of each of the plurality of banknotes.

14. The banknote handling apparatus according to claim 6, wherein the control unit sorts the plurality of banknotes based on portrait-upright/portrait-inverted orientation of each of the plurality of banknotes.

15. The banknote handling apparatus according to claim 6, wherein relation between the kind of the banknote and the outlet is determined by a user.

16. The banknote handling apparatus according to claim 6, wherein the banknote handling apparatus is connected to an operation terminal, and is operated based on an instruction issued by the operation terminal.

* * * * *